US009200812B2

(12) United States Patent
Narikawa et al.

(10) Patent No.: US 9,200,812 B2
(45) Date of Patent: Dec. 1, 2015

(54) HUMIDITY CONTROL APPARATUS

(75) Inventors: Yoshinori Narikawa, Osaka (JP); Takahiro Yukino, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1218 days.

(21) Appl. No.: 12/740,552

(22) PCT Filed: Oct. 23, 2008

(86) PCT No.: PCT/JP2008/003002

§ 371 (c)(1),
(2), (4) Date: Apr. 29, 2010

(87) PCT Pub. No.: WO2009/057264

PCT Pub. Date: Jul. 5, 2009

(65) Prior Publication Data

US 2010/0242521 A1 Sep. 30, 2010

(30) Foreign Application Priority Data

Oct. 31, 2007 (JP) ..... 2007-283632

(51) Int. Cl.

| | |
|---|---|
| ***F24F 3/14*** | (2006.01) |
| ***F25B 13/00*** | (2006.01) |
| ***F24F 11/00*** | (2006.01) |

(52) U.S. Cl.

CPC ..... *F24F 3/1411* (2013.01); *F24F 3/1429* (2013.01); *F24F 11/0015* (2013.01); *F24F 2221/22* (2013.01); *F25B 13/00* (2013.01)

(58) Field of Classification Search

USPC ..... 62/77, 298–299, 302, 271

See application file for complete search history.

(56) References Cited

U.S. PATENT DOCUMENTS

| | | | | |
|---|---|---|---|---|
| 5,140,830 | A * | 8/1992 | Sawyer | 62/298 |
| 6,196,008 | B1 * | 3/2001 | Fujitaka et al. | 62/77 |
| 7,448,225 | B2 * | 11/2008 | Iguchi et al. | 62/255 |
| 2006/0218943 | A1 * | 10/2006 | Yabu et al. | 62/94 |
| 2007/0028639 | A1 * | 2/2007 | Ikegami et al. | 62/271 |
| 2007/0144351 | A1 | 6/2007 | Taira et al. | |
| 2008/0156454 | A1 * | 7/2008 | Kim et al. | 165/59 |

FOREIGN PATENT DOCUMENTS

| | | | |
|---|---|---|---|
| JP | 1-73624 | U | 5/1989 |
| JP | 11-223380 | A | 8/1999 |
| JP | 2003-130388 | A | 5/2003 |
| JP | 2005-009767 | A | 1/2005 |
| JP | 2005-30734 | A | 2/2005 |
| JP | 2005-300112 | A | 10/2005 |
| JP | 2006-329596 | A | 12/2006 |
| JP | 2006-349304 | A | 12/2006 |
| JP | 2007-93125 | A | 4/2007 |

OTHER PUBLICATIONS

English Machine Translation for JP-11-223380-A.
English Machine Translation for JP-2005-30734-A.
English Machine Translation for JP-2006-329596-A.

* cited by examiner

*Primary Examiner* — Allana Lewin Bidder
*Assistant Examiner* — Zachary R Anderegg
(74) *Attorney, Agent, or Firm* — Birch, Stewart, Kolasch & Birch, LLP

(57) ABSTRACT

Adsorption heat exchangers (51, 52) are connected to a refrigerant circuit (50). The adsorption heat exchangers (51, 52) can be removed from the refrigerant circuit (50) via a plurality of joint members (64, 65, 66, 67). The adsorption heat exchangers (51, 52), removed from the refrigerant circuit (50), are pulled out to the outside of a casing (11) through maintenance openings (14*a*, 73*a*) of the casing (11).

8 Claims, 17 Drawing Sheets

HUMIDITY CONTROL APPARATUS

TECHNICAL FIELD

The present invention relates to a humidity control apparatus for controlling the humidity of the air with an adsorption heat exchanger carrying an adsorbent thereon, and more particularly to a measure for maintaining the adsorption heat exchanger.

BACKGROUND ART

A humidity control apparatus has been known in the art, which controls the humidity of the outside air or the room air, and supplies the humidity-controlled air into the room. As a humidity control apparatus of this type, Patent Document 1 discloses a humidity control apparatus including an adsorption heat exchanger carrying an adsorbent thereon.

The humidity control apparatus of Patent Document 1 includes a refrigerant circuit having refrigerant circulating therethrough to perform a refrigeration cycle. Connected to the refrigerant circuit are a compressor, a first adsorption heat exchanger, a second adsorption heat exchanger, an expansion valve, and a four-way switching valve. The compressor is provided in a predetermined chamber in the casing. The first adsorption heat exchanger and the second adsorption heat exchanger are provided respectively in two heat exchanger chambers in the casing.

In the refrigerant circuit, an operation in which the first adsorption heat exchanger serves as a condenser and the second adsorption heat exchanger as an evaporator, and another operation in which the second adsorption heat exchanger serves as a condenser and the first adsorption heat exchanger as an evaporator, are performed. In the adsorption heat exchanger operating as an evaporator, the moisture in the air is adsorbed by the adsorbent. In the adsorption heat exchanger operating as a condenser, the moisture is desorbed from the adsorbent and is given to the air.

The humidity control apparatus of Patent Document 1 supplies one of the air having passed through the adsorption heat exchangers into the room and discharges the other to the outside. For example, in the humidity control apparatus in a dehumidification mode, the passageway of the air in the casing is set so that the air having passed through one of the first and second adsorption heat exchangers that operates as an evaporator is supplied into the room and the air having passed through the other that operates as a condenser is discharged to the outside. In this humidity control apparatus, the passageway of the air is switched from one to another through the operation of opening/closing a plurality of dampers. Specifically, the humidity control apparatus changes the passageway of the air passing through the adsorption heat exchangers by opening/closing eight dampers so as to switch between the dehumidification mode, the humidification mode, etc.

Citation List

Patent Document

PATENT DOCUMENT 1: Japanese Patent Publication No. 2006-349304

SUMMARY OF THE INVENTION

Technical Problem

Now, in the humidity control apparatus disclosed in Patent Document 1, the adsorption heat exchangers are sometimes maintained as necessary. Specifically, for example, an adsorption heat exchanger carries an adsorbent on its surface, and the adsorbent needs to be maintained if the adsorbent deteriorates over a long-term use. However, conventional humidity control apparatuses of this type have not been made with sufficient consideration as to the maintenance of the adsorption heat exchanger. Therefore, there is a demand for a humidity control apparatus in which adsorption heat exchanger can be maintained easily.

The present invention has been made in view of the above, and has an object to provide a humidity control apparatus for controlling the humidity of the air with an adsorption heat exchanger, in which the maintenance of the adsorption heat exchanger is facilitated.

Solution to the Problem

A first aspect is directed to a humidity control apparatus including: a refrigerant circuit (50), to which an adsorption heat exchanger (51, 52) carrying an adsorbent thereon is connected and through which refrigerant circulates to perform a refrigeration cycle; and a casing (11) in which a heat exchanger chamber (37, 38) is formed in which the adsorption heat exchanger (51, 52) is placed, wherein the adsorbent of the adsorption heat exchanger (51, 52) is heated or cooled by the refrigerant of the refrigerant circuit (50) while bringing an air into contact with the adsorbent of the adsorption heat exchanger (51, 52), thereby controlling a humidity of the air. In the humidity control apparatus, the casing (11) has a maintenance opening (14*a*, 74*a*) formed therein for exposing an inside of the heat exchanger chambers (37, 38) to an outside of the casing (11), a plurality of joint members (64, 65, 66, 67) for removing the adsorption heat exchanger (51, 52) from the refrigerant circuit (50) are connected to the refrigerant circuit (50), and the adsorption heat exchanger (51, 52) can be pulled out to the outside of the casing (11) through the maintenance opening (14*a*, 74*a*).

In the first aspect, the adsorption heat exchanger (51, 52) is placed in the heat exchanger chamber (37, 38) of the casing (11). The refrigerant circulates through the refrigerant circuit (50) to perform a refrigeration cycle, thereby performing an operation in which the adsorption heat exchanger (51, 52) serves as an evaporator or a condenser. For example, in the adsorption heat exchanger (51, 52) serving as an evaporator, the adsorbent is cooled by the refrigerant. When the air contacts the adsorbent of the adsorption heat exchanger (51, 52) in this state, the moisture in the air is adsorbed by the adsorbent, and the resultant heat of adsorption is used as the heat of evaporation of the refrigerant. As the air, of which the moisture has been adsorbed, is supplied into the room, the room is dehumidified. For example, in the adsorption heat exchanger (52, 51) serving as a condenser, the adsorbent is heated by the refrigerant. When the air contacts the adsorbent of the adsorption heat exchanger (52, 51) in this state, the moisture desorbed from the adsorbent is given to the air. As the air, to which the moisture has been given, is supplied into the room, the room is humidified.

In this aspect, the adsorption heat exchanger (51, 52) is removably connected to the refrigerant circuit (50) by the joint members (64, 65, 66, 67). When maintaining the adsorption heat exchanger (51, 52), the maintenance opening (14*a*, 74*a*) is opened so that it is exposed to the outside of the heat exchanger chamber (37, 38). The adsorption heat exchanger (51, 52) is removed from the refrigerant circuit (50) by disconnecting the joint members (64, 65, 66, 67). The adsorption heat exchanger (51, 52) in this state is pulled out to the outside of the casing (11) through the maintenance opening (14*a*, 74*a*) so that the adsorption heat exchanger (51, 52) can be maintained.

After the completion of the maintenance of the adsorption heat exchanger (51, 52), the adsorption heat exchanger (51, 52) is put into the heat exchanger chamber (37, 38) through the maintenance opening (14*a*, 74*a*) so as to place the adsorption heat exchanger (51, 52) at the original position and connect it to the refrigerant circuit (50) via the joint members (64, 65, 66, 67). Thus, the humidity control apparatus can resume the dehumidification mode or the humidification mode described above.

A second aspect is directed to the humidity control apparatus of the first aspect, wherein a first adsorption heat exchanger (51) and a second adsorption heat exchanger (52) are connected by the plurality of joint members (64, 65, 66, 67) to the refrigerant circuit (50) so as to be removable from the refrigerant circuit (50), a first heat exchanger chamber (37) in which the first adsorption heat exchanger (51) is placed and a second heat exchanger chamber (38) in which the second adsorption heat exchanger (52) is placed are formed in the casing (11) in this order from a near side to a far side of the maintenance opening (14*a*, 74*a*), and the first adsorption heat exchanger (51) and the second adsorption heat exchanger (52) can be pulled out to the outside of the casing (11) through the maintenance opening (14*a*, 74*a*).

In the second aspect, the first adsorption heat exchanger (51) and the second adsorption heat exchanger (52) are connected to the refrigerant circuit (50), the first adsorption heat exchanger (51) is placed in the first heat exchanger chamber (37), and the second adsorption heat exchanger (52) is placed in the second heat exchanger chamber (38). Thus, this aspect allows for an operation of adsorbing the moisture of the air by using one of the adsorption heat exchangers (51, 52) as an evaporator while restoring the adsorbent by using the other one of the adsorption heat exchangers (52, 51) as a condenser.

In this aspect, both the first adsorption heat exchanger (51) and the second adsorption heat exchanger (52) can be taken in and out through the same maintenance opening (14*a*, 74*a*). Specifically, when maintaining the adsorption heat exchangers (51, 52), the joint members (64, 65, 66, 67) are disconnected from the adsorption heat exchangers (51, 52), and the adsorption heat exchangers (51, 52) are removed from the refrigerant circuit (50). Then, the first adsorption heat exchanger (51) and the second adsorption heat exchanger (52) are pulled out to the outside of the casing (11). Thus, both of the adsorption heat exchangers (51, 52) can be pulled out to the same side of the casing (11) for a maintenance.

A third aspect is directed to the humidity control apparatus of the second aspect, wherein a partition (73) is formed between the first heat exchanger chamber (37) and the second heat exchanger chamber (38) for separating the heat exchanger chambers (37, 38) from each other, and a partition opening (73*a*) through which the second adsorption heat exchanger (52) can pass is formed in the partition (73) so as to allow the second adsorption heat exchanger (52) to move between the heat exchanger chambers (37, 38).

In the third aspect, the partition (73) is provided between the first heat exchanger chamber (37) and the second heat exchanger chamber (38). The partition opening (73*a*) through which the second adsorption heat exchanger (52) can pass is formed in the partition (73). Therefore, in this aspect, the second adsorption heat exchanger (52) can be pulled out to the outside of the casing (11) through the maintenance opening (14*a*, 74*a*) with the partition (73) attached to the casing (11).

Specifically, when maintaining the adsorption heat exchangers (51, 52), the adsorption heat exchangers (51, 52) are removed from the refrigerant circuit (50). The first adsorption heat exchanger (51) is pulled out, in this state, to the outside of the casing (11) through the maintenance opening (14*a*, 74*a*). The second adsorption heat exchanger (52) of the second heat exchanger chamber (38) is pulled out into the first heat exchanger chamber (37) through the partition opening (73*a*) of the partition (73), and then further pulled out to the outside of the casing (11) through the maintenance opening (14*a*, 74*a*). Thus, the second adsorption heat exchanger (52) can be maintained without removing the partition (73) from the casing (11).

A fourth aspect is directed to the humidity control apparatus of the third aspect, wherein the second adsorption heat exchanger (52) has a plurality of heat transfer pipes (58) and a tube plate (60*a*) provided thereon, the heat transfer pipes (58) extending in an arrangement direction of the two heat exchanger chambers (37, 38), and the tube plate (60*a*) supporting an end portion of each of the heat transfer pipes (58) on the partition (73) side, and the tube plate (60*a*) on the partition (73) side of the second adsorption heat exchanger (52) serves also as a blocking member for blocking the partition opening (73*a*) of the partition (73) in a state where the second adsorption heat exchanger (52) is placed in the second heat exchanger chamber (38).

In the fourth aspect, the tube plate (60*a*) of the second adsorption heat exchanger (52) blocks the partition opening (73*a*) of the partition (73) in a state where the second adsorption heat exchanger (52) is placed at a predetermined position in the second heat exchanger chamber (38). That is, the tube plate (60*a*) of the second adsorption heat exchanger (52) serves not only as a member for supporting the heat transfer pipes (58) but also as a blocking member for blocking the partition opening (73*a*) in a normal placement position. Therefore, since the tube plate (60*a*) suppresses the leakage of the air between the first heat exchanger chamber (37) and the second heat exchanger chamber (38), it is possible to realize a desired effect of controlling the humidity of the air through the heat exchanger chambers (37, 38).

A fifth aspect is directed to the second aspect, wherein a first joint member (64), which is connected to a gas-side pipe (61) of the first adsorption heat exchanger (51), a second joint member (67), which is connected to a gas-side pipe (63) of the second adsorption heat exchanger (52), and a third joint member (65), which is connected to a liquid-side pipe (62) between the first adsorption heat exchanger (51) and the second adsorption heat exchanger (52), are connected to the refrigerant circuit (50).

In the fifth aspect, the refrigerant circuit (50) is provided with at least three joint members (64, 67, 65). Specifically, the gas-side pipe (61) of the first adsorption heat exchanger (51) is provided with the first joint member (64), the gas-side pipe (63) of the second adsorption heat exchanger (52) is provided with the second joint member (67), and the liquid-side pipe (62) between the adsorption heat exchangers (51, 52) is provided with the third joint member (65).

In this aspect, the adsorption heat exchangers (51, 52) can be separately pulled out by disconnecting the joint members (64, 67, 65). Specifically, as the first joint member (64) and the third joint member (65) are disconnected, the first adsorption heat exchanger (51) is removed from the gas-side pipe (61) and the liquid-side pipe (62) of the refrigerant circuit (50). Then, the first adsorption heat exchanger (51) can be separately pulled out to the outside of the casing (11) through the maintenance opening (14*a*, 74*a*). As the second joint member (67) and the third joint member (65) are disconnected, the second adsorption heat exchanger (52) is removed from the gas-side pipe (63) and the liquid-side pipe (62) of the refrigerant circuit (50). Then, the second adsorption heat exchanger (52) can be pulled out to the outside of the casing (11) through the maintenance opening (14*a*, 74*a*).

A sixth aspect is directed to the humidity control apparatus of the fifth aspect, wherein the third joint member (65) and a fourth joint member (66) are connected to the liquid-side pipe (62) in this order from a side of the first adsorption heat exchanger (51) toward a side of the second adsorption heat exchanger (52), and the third joint member (65) is placed closer to the maintenance opening (14*a*, 74*a*) in the first heat exchanger chamber (37), and the fourth joint member (66) is placed closer to a side opposite to the maintenance opening (14*a*, 74*a*) in the first heat exchanger chamber (37).

In the sixth aspect, the liquid-side pipe (62) between the adsorption heat exchangers (51, 52) in the refrigerant circuit (50) is provided with the third joint member (65) and the fourth joint member (66). The third joint member (65) is connected to a pipe closer to the first adsorption heat exchanger (51), and is placed closer to the maintenance opening (14*a*, 74*a*) in the first heat exchanger chamber (37). Therefore, during maintenance, the third joint member (65) can easily be connected and disconnected.

On the other hand, the fourth joint member (66) is connected to a pipe closer to the second adsorption heat exchanger (52), and is placed closer to the side opposite to the maintenance opening (14*a*, 74*a*) in the first heat exchanger chamber (37). Therefore, during maintenance, the fourth joint member (66) can be connected and disconnected from the side of the first heat exchanger chamber (37). If the third joint member (65) and the fourth joint member (66) are both disconnected, the pipe (the liquid-side pipe) between the third joint member (65) and the fourth joint member (66) can be removed from the refrigerant circuit (50).

Here, since the liquid-side pipe between the third joint member (65) and the fourth joint member (66) is provided extending from the side of the maintenance opening (14*a*, 74*a*) toward the opposite side in the first heat exchanger chamber (37), the pipe length is relatively large. Therefore, if this pipe cannot be removed from the first adsorption heat exchanger (51) or the second adsorption heat exchanger (52), it is necessary to provide, outside the casing (11), a space into which the pipe is to be pulled out in addition to the space into which the adsorption heat exchangers (51, 52) are to be pulled out. As a result, there is a limitation on the location where the humidity control apparatus is placed.

In contrast, in this aspect, since the liquid-side pipe (62) is provided with the third joint member (65) and the fourth joint member (66), it is possible to remove the pipe between these joint members (65, 66) from the refrigerant circuit (50), and to pull out this pipe to the outside of the casing (11) separately from the adsorption heat exchangers (51, 52). Therefore, it is possible to minimize the space into which the adsorption heat exchangers (51, 52) are to be pulled out.

A seventh aspect is directed to the humidity control apparatus of the second aspect, wherein the plurality of joint members (64, 65, 66, 67) are all placed in the first heat exchanger chamber (37).

In the seventh aspect, the joint members (64, 65, 66, 67) for removing the adsorption heat exchangers (51, 52) from the refrigerant circuit (50) are all put together in the first heat exchanger chamber (37). Here, since the first heat exchanger chamber (37) is located on the near side relative to the maintenance opening (14*a*, 74*a*), all the joint members (64, 65, 66, 67) can easily be connected and disconnected from the side of the maintenance opening (14*a*, 74*a*).

An eighth aspect is directed to the humidity control apparatus of the first aspect, wherein the heat exchanger chamber (37) includes spaces (37*a*, 37*b*), one defined on an upstream side of the adsorption heat exchanger (51) and another defined on a downstream side of the adsorption heat exchanger (51), with the adsorption heat exchanger (51) interposed therebetween, a width dimension in an air flow direction of one (37*b*) of the space (37*a*) on the upstream side and the space (37*b*) on the downstream side is larger than a width dimension in the air flow direction of the other space (37*a*), and the joint members (64, 65, 66, 67) are provided in one (37*b*) of the spaces of the larger width dimension in the heat exchanger chamber (37).

In the eighth aspect, the space in the heat exchanger chamber (37) is partitioned into a space on the upstream side of the adsorption heat exchanger (51) and another space on the downstream side of the adsorption heat exchanger (51). Of the two spaces, the width dimension (the interval in the air flow direction) of one space is larger than the width dimension of the other space. Here, in this aspect, the joint members (64, 65, 66, 67) are provided in one of the spaces with the larger width dimension. Therefore, there is a larger space around the joint members (64, 65, 66, 67), making it easier to perform the operation of connecting and disconnecting the joint members (64, 65, 66, 67).

A ninth aspect is directed to the eighth humidity control apparatus, wherein the width dimension of the space (37*b*) on the downstream side of the adsorption heat exchanger (51) in the heat exchanger chamber (37) is larger than the width dimension of the space (37*a*) on the upstream side of the adsorption heat exchanger (51).

In the ninth aspect, the space (37*b*) on the downstream side of the adsorption heat exchanger (51) in the heat exchanger chamber (37) is wider than the space (37*a*) on the upstream side of the adsorption heat exchanger (51). The joint members (64, 65, 66, 67) are provided in the space (37*b*) on the downstream side. Therefore, in the space (37*b*) on the downstream side of the adsorption heat exchanger (51), there is a large space around the joint members (64, 65, 66, 67), making it easier to perform the operation of connecting and disconnecting the joint members (64, 65, 66, 67).

A tenth aspect is directed to the humidity control apparatus of one of claims 1-9, wherein the heat exchanger chamber (37, 38) is provided with a rail member (102, 102), extending in a direction in which the adsorption heat exchanger (51, 52) is pulled out, for guiding the adsorption heat exchanger (51, 52) toward the maintenance opening (14*a*, 74*a*).

In the tenth aspect, the heat exchanger chamber (37, 38) is provided with the rail member (102, 102). When maintaining the adsorption heat exchangers (51, 52), the adsorption heat exchanger (51, 52) is pulled out toward the maintenance opening (14*a*, 74*a*) along the rail member (102, 102). This makes it easier to take the adsorption heat exchangers (51, 52) in and out of the casing (11).

Advantages of the Invention

In the present invention, the adsorption heat exchanger (51, 52) can be removed from the refrigerant circuit (50), and the adsorption heat exchanger (51, 52) of the heat exchanger chamber (37, 38) can be pulled out to the outside of the casing (11) through the maintenance opening (14*a*, 74*a*). Therefore, it is possible to easily take out the adsorption heat exchanger (51, 52) to the outside of the casing (11) for a maintenance.

According to the second aspect, two adsorption heat exchangers (51, 52) can be taken out to the outside of the casing (11) through the maintenance opening (14*a*, 74*a*) for the maintenance of the adsorption heat exchangers (51, 52). Here, since the adsorption heat exchangers (51, 52) can be taken out through the same maintenance opening (14*a*, 74*a*), it is possible to minimize the maintenance space around the casing (11) and to simplify the apparatus structure.

Moreover, in the third aspect, the partition opening (73*a*) through which the second adsorption heat exchanger (52) can pass is formed in the partition (73) for separating the two heat exchanger chambers (37, 38) from each other. Thus, in this aspect, without removing the partition (73) from the casing (11), the second adsorption heat exchanger (52) of the second heat exchanger chamber (38) can be moved into the first heat exchanger chamber (37) through the partition opening (73*a*), and further pulled out to the outside of the casing (11) from the first heat exchanger chamber (37) through the partition opening (73*a*). Therefore, it is possible to maintain the second adsorption heat exchanger (52) with a relatively simple structure.

Particularly, in the fourth aspect, the tube plate (60*a*) of the second adsorption heat exchanger (52) serves also as a blocking member for blocking the partition opening (73*a*) when the second adsorption heat exchanger (52) is in a normal placement position. Thus, according to this aspect, it is possible, without increasing the number of components, to suppress the leakage of the air through the partition opening (73*a*), and to thereby realize a desired humidity-controlling capacity with this humidity control apparatus.

According to the fifth aspect, since the refrigerant circuit (50) is provided with at least three joint members (64, 67, 65), the first adsorption heat exchanger (51) and the second adsorption heat exchanger (52) can be separately removed from the refrigerant circuit (50). Therefore, the adsorption heat exchangers (51, 52) can be separately pulled out to the outside of the casing (11), thus improving the ease of maintenance. It is possible to reduce the maintenance space around the casing (11) as compared with a case where the adsorption heat exchangers (51, 52) are pulled out at the same time.

Particularly, in the sixth aspect, the third joint member (65) and the fourth joint member (66) are connected to the liquid-side pipe (62) between the first adsorption heat exchanger (51) and the second adsorption heat exchanger (52). Then, the third joint member (65) closer to the first adsorption heat exchanger (51) is placed closer to the maintenance opening (14*a*, 74*a*) in the first heat exchanger chamber (37), and the fourth joint member (66) closer to the second adsorption heat exchanger (52) is placed closer to the side opposite to the maintenance opening (14*a*, 74*a*) in the first heat exchanger chamber (37). Thus, according to this aspect, it is possible to easily perform the operation of connecting and disconnecting the third joint member (65) from the side of the maintenance opening (14*a*, 74*a*). It is also possible to perform the operation of connecting and disconnecting the fourth joint member (66) from the side of the first heat exchanger chamber (37).

In addition, in the sixth aspect, since the pipe between the third joint member (65) and the fourth joint member (66) can be removed from the refrigerant circuit (50), the pipe can be pulled out through the maintenance opening (14*a*, 74*a*) separately from the adsorption heat exchangers (51, 52). Therefore, it is possible to further reduce the maintenance space around the casing (11).

According to the seventh aspect, since all the joint members (64, 65, 66, 67) are provided on the side of the first heat exchanger chamber (37), it is possible to easily perform the operation of connecting and disconnecting the joint members (64, 65, 66, 67) from the side of the maintenance opening (14*a*, 74*a*).

Moreover, in the eighth and ninth aspects, of the spaces (37*a*, 37*b*) on the upstream side and the downstream side of the adsorption heat exchanger (51) in the heat exchanger chambers (37, 38), the joint members (64, 65, 66, 67) are provided in the wider space (37*b*). Thus, according to this aspect, it is possible to provide a sufficient space for performing the operation of connecting and disconnecting the joint members (64, 65, 66, 67), thus further improving the ease of maintenance.

According to the tenth aspect, the heat exchanger chamber (37, 38) is provided with the rail member (102, 102) for guiding the adsorption heat exchanger (51, 52), making it easier to perform the operation of taking the adsorption heat exchanger (51, 52) in and out, thus further improving the ease of maintenance.

DESCRIPTION OF REFERENCE CHARACTERS

Figure 1:
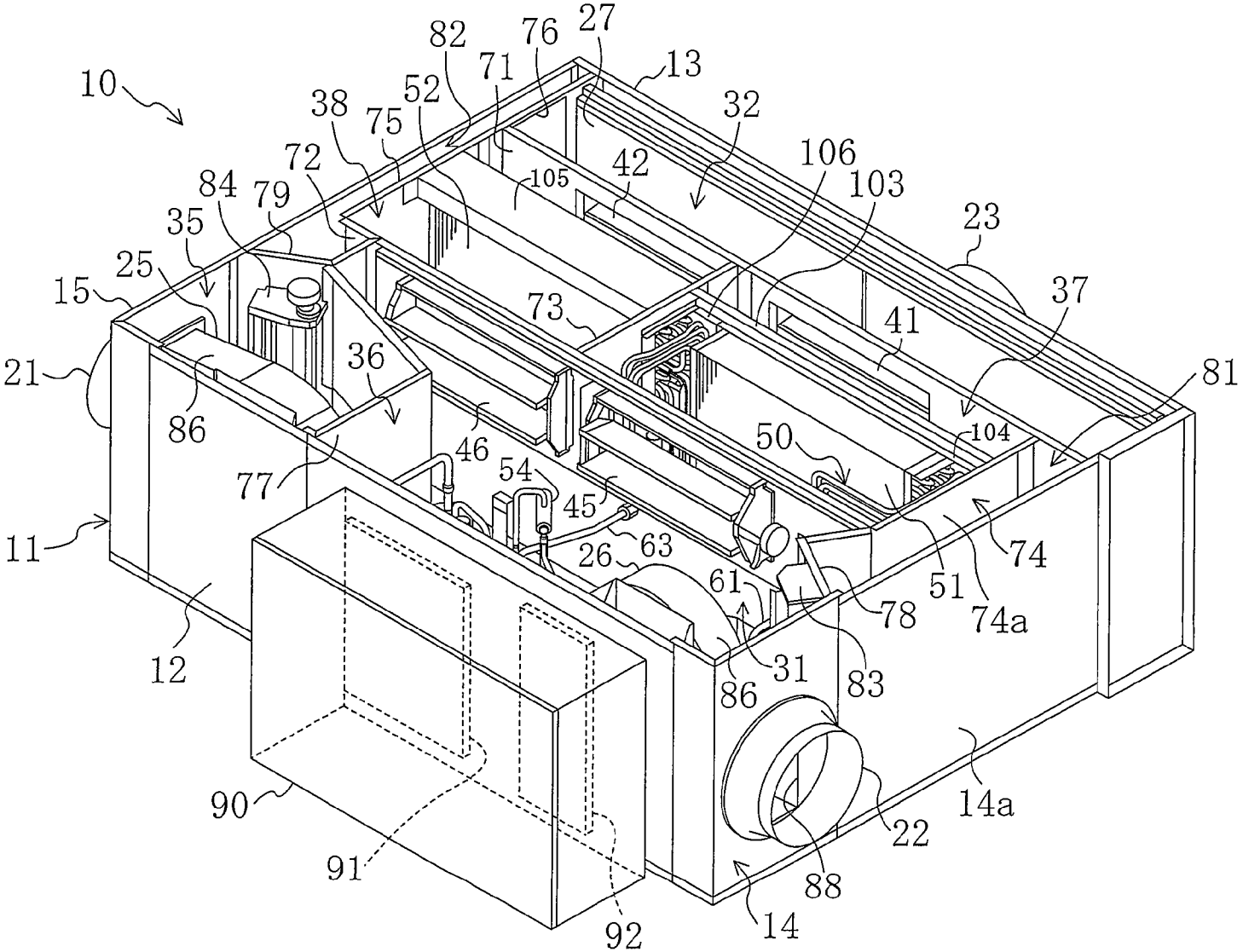
FIG. 1 is a perspective view showing a humidity control apparatus as viewed from the front surface side, omitting the top plate of the casing.

10 Humidity control apparatus
11 Casing

14*a* First open/close panel (maintenance opening)
37 First heat exchanger chamber (heat exchanger chamber)
37*a* First upstream-side space (space on upstream side)
37*b* First downstream-side space (space on downstream side)
38 Second heat exchanger chamber (heat exchanger chamber)
50 Refrigerant circuit
51 First adsorption heat exchanger (adsorption heat exchanger)
52 Second adsorption heat exchanger (adsorption heat exchanger)
58 Heat transfer pipe
60*a* Tube plate
61 First connection pipe (gas-side pipe)
62 Intermediate pipe (liquid-side pipe)
63 Second connection pipe (gas-side pipe)
64 First joint member
65 Third joint member
66 Fourth joint member
67 Second joint member
73 Partition
73*a* Partition opening
74*a* Second open/close panel (maintenance opening)
102 Rail member

DESCRIPTION OF EMBODIMENTS

An embodiment of the present invention will now be described with reference to the drawings. A humidity control apparatus (10) of the present embodiment is for controlling the humidity of the room while also ventilating the room, and the humidity control apparatus (10) controls the humidity of the received outside air (OA) to supply the outside air into the room while simultaneously discharging the received room air (RA) to the outside.

<Generation Configuration Of Humidity Control Apparatus>

The humidity control apparatus (10) will be described with reference to FIGS. 1-5 as necessary. Note that the terms "upper," "lower," "left," "right," "front," "rear," "near" and "far" as used herein refer to the respective directions as the humidity control apparatus (10) is viewed from the front surface side.

The humidity control apparatus (10) includes a casing (11). A refrigerant circuit (50) is accommodated in the casing (11). A first adsorption heat exchanger (51), a second adsorption heat exchanger (52), a compressor (53), a four-way switching valve (54) and an electric expansion valve (55) are connected to the refrigerant circuit (50). The details of the refrigerant circuit (50) will be described later.

The casing (11) is formed in a rectangular parallelepiped shape that is slightly flattened and has a relatively low height. The width of the casing (11) in the left-right direction is somewhat larger than the depth thereof (see FIG. 3). The portion of the casing (11) forming the near left side surface in FIG. 1 (i.e., the front surface) is a front surface panel portion (12), and the portion forming the far right side surface in the figure (i.e., the rear surface) is a rear surface panel portion (13). The portion of the casing (11) forming the near right side surface in the figure is a first side surface panel portion (14), and the portion forming the far left side surface in the figure is a second side surface panel portion (15). In the casing (11), the front surface panel portion (12) and the rear surface panel portion (13) oppose each other, and the first side surface panel portion (14) and the second side surface panel portion (15) oppose each other.

The casing (11) is provided with an outside air inlet port (24), an inside air inlet port (23), an air-supplying port (22) and an exhaust port (21).

Figure 3:
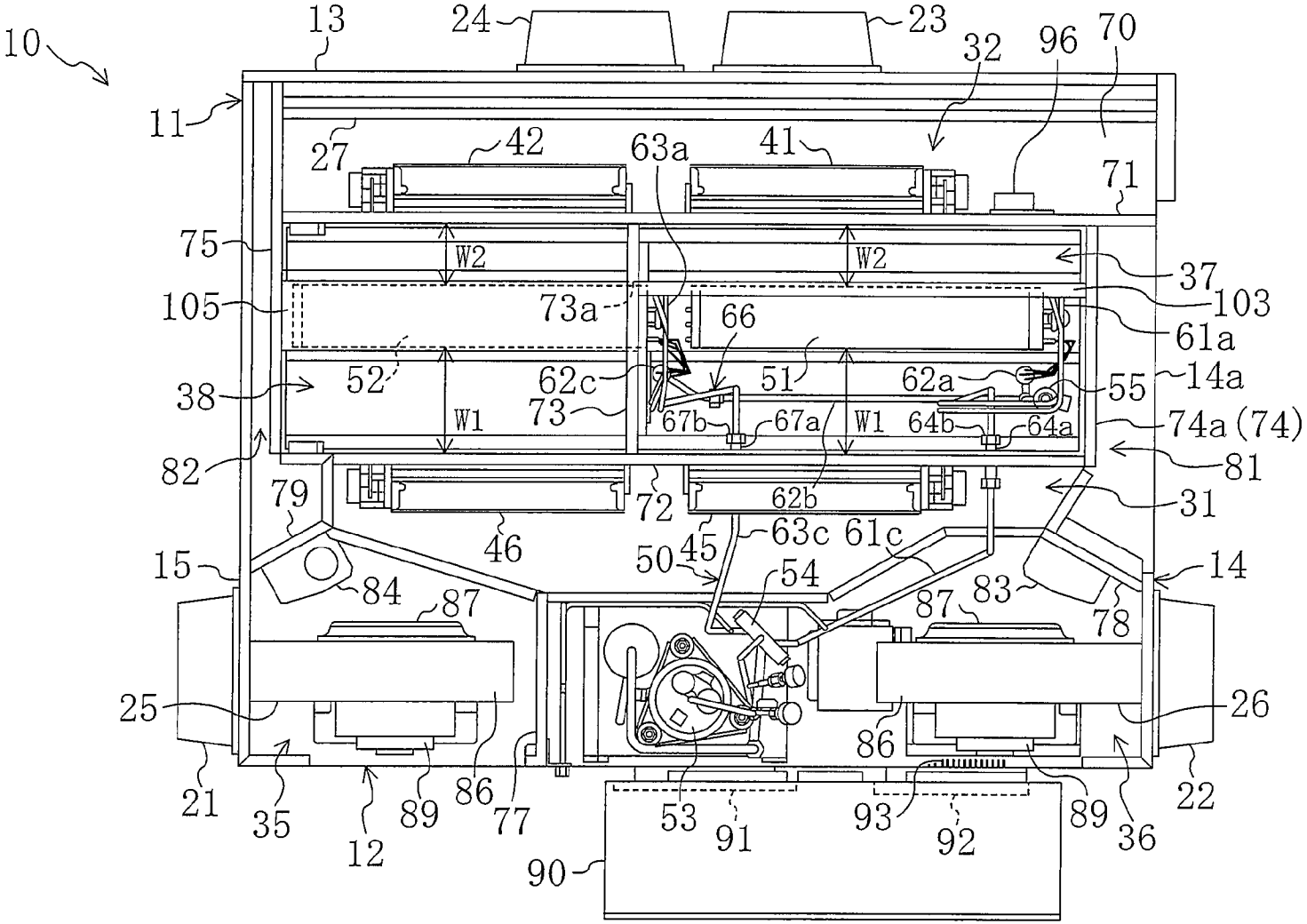
FIG. 3 is a plan view showing the humidity control apparatus, omitting the top plate of the casing.
Figure 4:
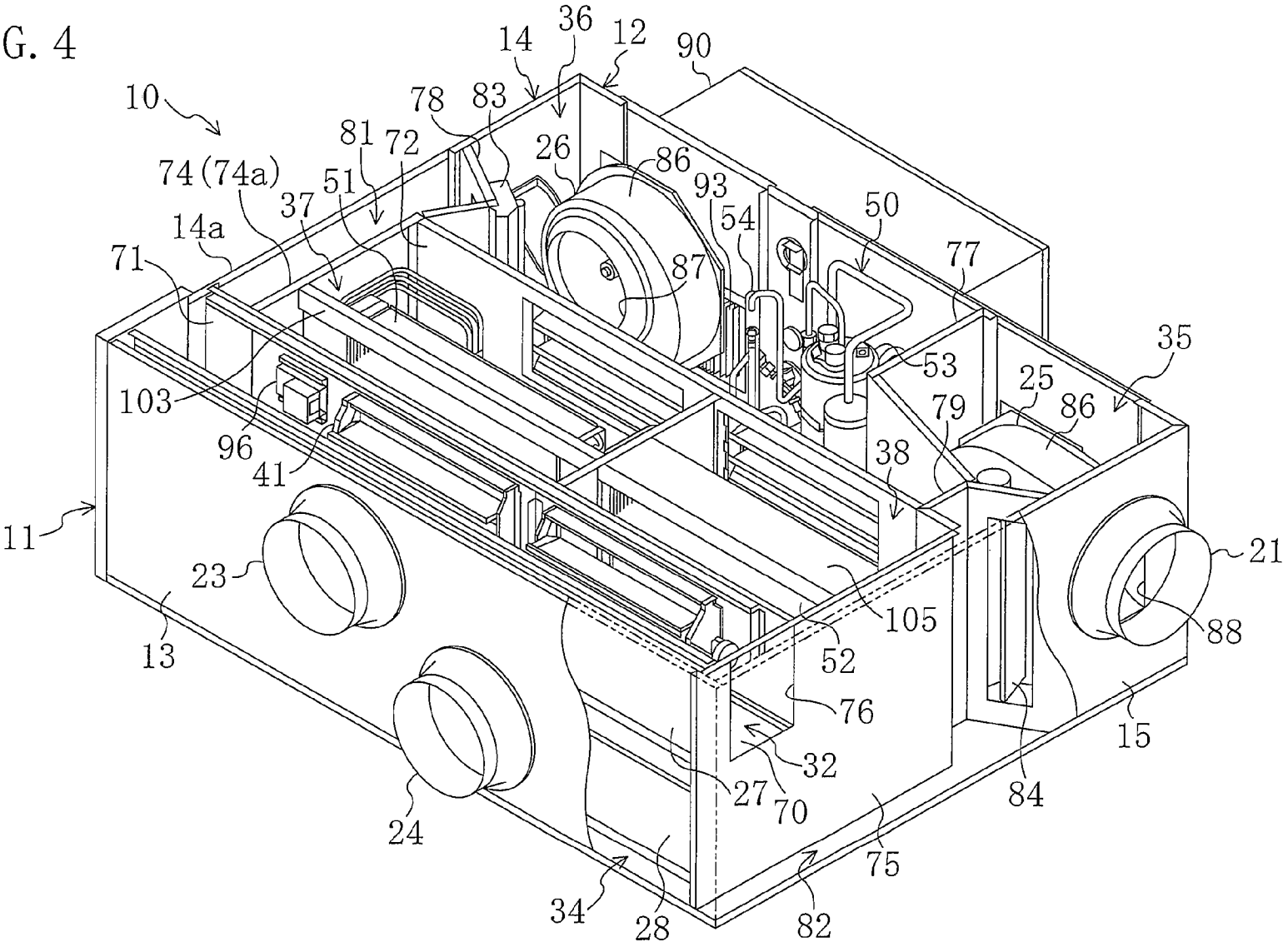
FIG. 4 is a perspective view showing the humidity control apparatus as viewed from the rear surface side, omitting the top plate of the casing.

The outside air inlet port (24) and the inside air inlet port (23) are opened in the rear surface panel portion (13) (see FIG. 3, FIG. 4). The outside air inlet port (24) is placed in a lower portion of the rear surface panel portion (13). The outside air inlet port (24) is provided at a position that is offset toward the second side surface panel portion (15) from the center of the rear surface panel portion (13) in the left-right width direction. The inside air inlet port (23) is placed in an upper portion of the rear surface panel portion (13). The inside air inlet port (23) is provided at a position that is offset toward the first side surface panel portion (14) from the center of the rear surface panel portion (13) in the left-right width direction.

The air-supplying port (22) is placed near an end portion of the first side surface panel portion (14) toward the front surface panel portion (12). The exhaust port (21) is placed near an end portion of the second side surface panel portion (15) toward the front surface panel portion (12).

In the internal space of the casing (11), an upstream-side partition (71), a downstream-side partition (72), a center partition (73), a first partition (74), and a second partition (75) are provided. These partitions (71-75) are each provided upright on the bottom plate of the casing (11), partitioning the internal space of the casing (11) from the bottom plate to the top plate of the casing (11).

The upstream-side partition (71) and the downstream-side partition (72) are placed parallel to the front surface panel portion (12) and the rear surface panel portion (13). In the internal space of the casing (11), the upstream-side partition (71) is placed closer to the rear surface panel portion (13), and the downstream-side partition (72) is placed closer to the front surface panel portion (12).

The width of the upstream-side partition (71) in the left-right direction is shorter than the width of the casing (11) in the left-right direction. The right end portion of the upstream-side partition (71) is attached to the first side surface panel portion (14). On the other hand, a gap is formed between the left end portion of the upstream-side partition (71) and the second side surface panel portion (15).

The width of the downstream-side partition (72) in the left-right direction is shorter than the width of the upstream-side partition (71) in the left-right direction. A gap is formed between the right end portion of the downstream-side partition (72) and the first side surface panel portion (14). A gap is formed also between the left end portion of the downstream-side partition (72) and the second side surface panel portion (15).

The first partition (74) is placed so as to cover the space between the upstream-side partition (71) and the downstream-side partition (72) from the right side. Specifically, the first partition (74) is placed in an orientation parallel to the first side surface panel portion (14) and perpendicular to the upstream-side partition (71) and the downstream-side partition (72). The front end portion of the first partition (74) is attached to the right end portion of the downstream-side partition (72). The rear end portion of the first partition (74) is attached to the downstream-side partition (72).

The second partition (75) is placed so as to cover the space between the upstream-side partition (71) and the downstream-side partition (72) from the left side. Specifically, the second partition (75) is placed in an orientation parallel to the second side surface panel portion (15) and perpendicular to the upstream-side partition (71) and the downstream-side partition (72). The front end portion of the second partition (75) is attached to the left end portion of the downstream-side partition (72). The rear end portion of the second partition (75) is attached to the rear surface panel portion (13). The left end portion of the upstream-side partition (71) is attached to the second partition (75).

The center partition (73) is placed between the upstream-side partition (71) and the downstream-side partition (72) in an orientation perpendicular to the upstream-side partition (71) and the downstream-side partition (72). The center partition (73) is provided extending from the upstream-side partition (71) to the downstream-side partition (72), partitioning the space between the upstream-side partition (71) and the downstream-side partition (72) into left and right portions. The center partition (73) is provided at a position somewhat shifted toward the second side surface panel portion (15) with respect to the center of the upstream-side partition (71) and the downstream-side partition (72) in the left-right width direction.

Figure 2:
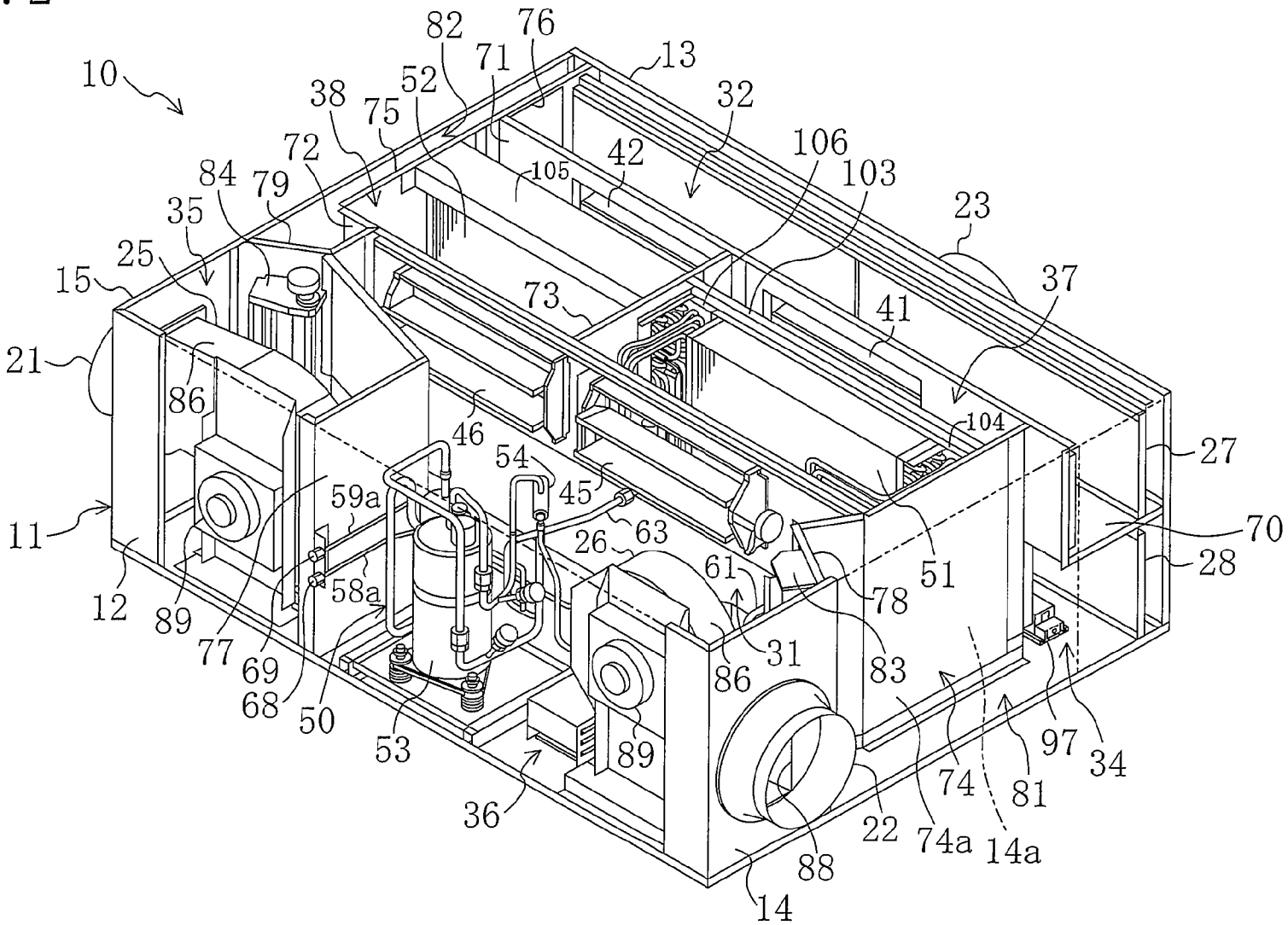
FIG. 2 is a perspective view showing the humidity control apparatus as viewed from the front surface side, omitting a part of the casing and the electrical component box.
Figure 5:
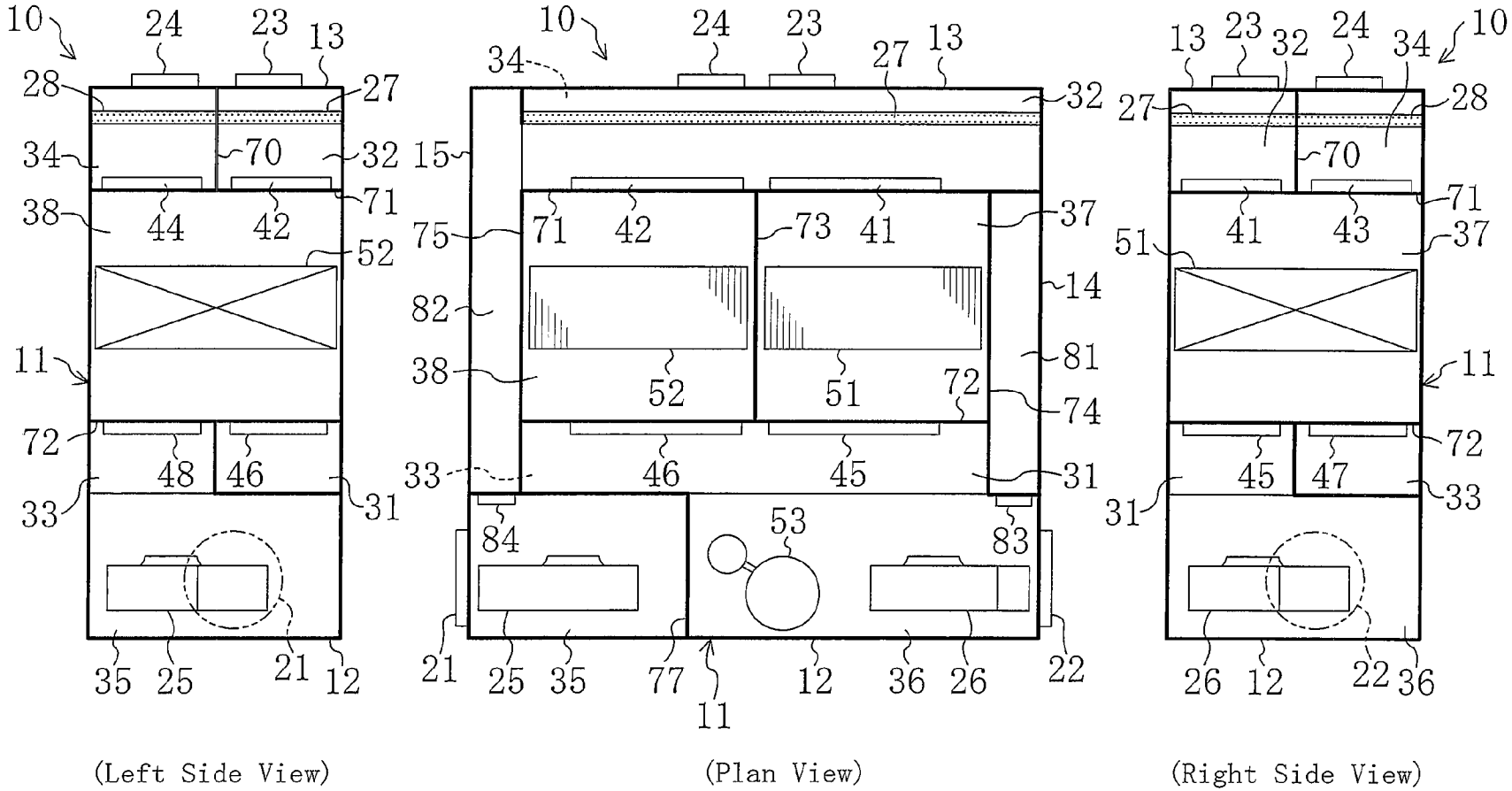
FIG. 5 shows a schematic plan view, a right side view and a left side view showing the humidity control apparatus, omitting a part thereof.

An inside/outside passageway partition (70) is also formed in the internal space of the casing (11) (see FIG. 2, FIG. 4, FIG. 5). The inside/outside passageway partition (70) is placed between the upstream-side partition (71) and the rear surface panel portion (13) in a horizontal orientation such that it is perpendicular to the upstream-side partition (71) and the rear surface panel portion (13). The inside/outside passageway partition (70) partitions the space between the upstream-side partition (71) and the rear surface panel portion (13) into two, upper and lower, spaces. Of the upper and lower partitioned spaces, the upper space forms an inside air-side passageway (32), and the lower space forms an outside air-side passageway (34). That is, the inside/outside passageway partition (70) forms a partition interposed between the inside air-side passageway (32) and the outside air-side passageway (34) so as to separate these passageways (32, 34) from each other.

The outside air-side passageway (34) communicates with the outside space via a duct connected to the outside air inlet port (24). That is, the outside air-side passageway (34) forms a first air passageway where the outside air flows, which is taken into the casing (11). The outside air-side passageway (34) is provided with an outside air-side filter (28) for removing dust, etc., from the air. The outside air-side filter (28) is formed in a rectangular plate shape whose long side extends in the left-right width direction, and is provided upright in an orientation such that it extends through the outside air-side passageway (34). The outside air-side passageway (34) is partitioned by the outside air-side filter (28) into front and rear portions. An outside air humidity sensor (97) for detecting the humidity of the outside air flowing through the outside air-side passageway (34) is accommodated in a portion of the outside air-side passageway (34) that is on the front side (downstream side) of the outside air-side filter (28) (see FIG. 2).

The inside air-side passageway (32) communicates with the room via a duct connected to the inside air inlet port (23). That is, the inside air-side passageway (32) forms a second air passageway where the room air flows, which is taken into the casing (11). The inside air-side passageway (32) is provided with an inside air-side filter (27) for removing dust, etc., from the air. The inside air-side filter (27) is formed in a rectangular plate shape whose long side extends in the left-right width direction, and is provided upright in an orientation such that it extends through the inside air-side passageway (32). The inside air-side passageway (32) is partitioned by the inside air-side filter (27) into front and rear portions. An inside air humidity sensor (96) for detecting the humidity of the room air flowing through the inside air-side passageway (32) is accommodated in a portion of the inside air-side passageway (32) that is on the front side (downstream side) of the inside air-side filter (27) (see FIG. 3, FIG. 4).

As described above, the space in the casing (11) between the upstream-side partition (71) and the downstream-side partition (72) is partitioned by the center partition (73) into left and right portions. Of the left and right partitioned spaces, the space on the right side of the center partition (73) forms a first heat exchanger chamber (37), and the space on the left side of the center partition (73) forms a second heat exchanger chamber (38) (see FIG. 1, FIG. 3).

The first adsorption heat exchanger (51) is accommodated in the first heat exchanger chamber (37). The second adsorption heat exchanger (52) is accommodated in the second heat exchanger chamber (38). Each of the adsorption heat exchangers (51, 52) as a whole is formed in a rectangular thick plate shape or a flattened rectangular parallelepiped shape. The details of the adsorption heat exchangers (51, 52) will be described later.

In the internal space of the casing (11), a portion along the front surface of the downstream-side partition (72) is partitioned into upper and lower portions (see FIG. 2, FIG. 3, FIG. 5). Of the upper and lower partitioned spaces, the upper space forms an air-supplying-side passageway (31), and the lower space forms an exhaust-side passageway (33).

The upstream-side partition (71) separates the heat exchanger chambers (37, 38) from the inside air-side passageway (32) and the outside air-side passageway (34), and also forms a damper-side partition including a plurality of dampers (41-44). Specifically, the upstream-side partition (71) is provided with four dampers (41-44) (see FIG. 3, FIG. 5) that can be opened/closed for connecting/disconnecting the heat exchanger chambers (37, 38) with the inside air-side passageway (32) and the outside air-side passageway (34). Each of the dampers (41-44) is generally formed in a horizontally-oriented rectangular shape. Specifically, in a portion (upper portion) of the upstream-side partition (71) that is facing the inside air-side passageway (32), the first inside air-side damper (41) is attached on the right of the center partition (73), and the second inside air-side damper (42) is attached on the left of the center partition (73). In a portion (lower portion) of the upstream-side partition (71) that is facing the outside air-side passageway (34), the first outside air-side damper (43) is attached on the right of the center partition (73), and the second outside air-side damper (44) is attached on the left of the center partition (73).

The connection between the inside air-side passageway (32) and the first heat exchanger chamber (37) is connected/disconnected as the first inside air-side damper (41) is opened/closed. The connection between the inside air-side passageway (32) and the second heat exchanger chamber (38) is connected/disconnected as the second inside air-side damper (42) is opened/closed. The connection between the outside air-side passageway (34) and the first heat exchanger chamber (37) is connected/disconnected as the first outside air-side damper (43) is opened/closed. The connection between the outside air-side passageway (34) and the second heat exchanger chamber (38) is connected/disconnected as the second outside air-side damper (44) is opened/closed.

On the upstream-side partition (71), the first outside air-side damper (43) is placed directly below the first inside air-side damper (41). The first inside air-side damper (41) and the first outside air-side damper (43) are each placed at a position such that the center thereof in the left-right width direction is closer to the center partition (73) (i.e., closer to the second side surface panel portion (15)) with respect to the center of the first heat exchanger chamber (37) in the left-right width direction (see FIG. 3).

On the upstream-side partition (71), the second outside air-side damper (44) is placed directly below the second inside air-side damper (42). The second inside air-side damper (42) and the second outside air-side damper (44) are each placed at a position such that the center thereof in the left-right width direction is closer to the center partition (73) (i.e., closer to the first side surface panel portion (14)) with respect to the center of the second heat exchanger chamber (38) in the left-right width direction (see FIG. 3).

The downstream-side partition (72) is provided with four dampers (45-48) that can be opened/closed (see FIG. 3, FIG. 5). Each of the dampers (45-48) is generally formed in a horizontally-oriented rectangular shape. Specifically, in a portion (upper portion) of the downstream-side partition (72) that is facing the air-supplying-side passageway (31), the first air-supplying-side damper (45) is attached on the right of the center partition (73), and the second air-supplying-side damper (46) is attached on the left of the center partition (73). In a portion (lower portion) of the downstream-side partition (72) that is facing the exhaust-side passageway (33), the first exhaust-side damper (47) is attached on the right of the center partition (73), and the second exhaust-side damper (48) is attached on the left of the center partition (73).

The connection between the air-supplying-side passageway (31) and the first heat exchanger chamber (37) is connected/disconnected as the first air-supplying-side damper (45) is opened/closed. The connection between the air-supplying-side passageway (31) and the second heat exchanger chamber (38) is connected/disconnected as the second air-supplying-side damper (46) is opened/closed. The connection between the exhaust-side passageway (33) and the first heat exchanger chamber (37) is connected/disconnected as the first exhaust-side damper (47) is opened/closed. The connection between the exhaust-side passageway (33) and the second heat exchanger chamber (38) is connected/disconnected as the second exhaust-side damper (48) is opened/closed.

On the downstream-side partition (72), the first exhaust-side damper (47) is placed directly below the first air-supplying-side damper (45). The first air-supplying-side damper (45) and the first exhaust-side damper (47) are each placed at a position such that the center thereof in the left-right width direction is closer to the center partition (73) (i.e., closer to the second side surface panel portion (15)) with respect to the center of the first heat exchanger chamber (37) in the left-right width direction (see FIG. 3).

On the downstream-side partition (72), the second exhaust-side damper (48) is placed directly below the second air-supplying-side damper (46). The second exhaust-side damper (48) and the second air-supplying-side damper (46) are each placed at a position such that the center thereof in the left-right width direction is closer to the center partition (73) (i.e., closer to the first side surface panel portion (14)) with respect to the center of the second heat exchanger chamber (38) in the left-right width direction (see FIG. 3).

In the casing (11), the space between the air-supplying-side passageway (31) and the exhaust-side passageway (33) and the front surface panel portion (12) is partitioned by air-supplying/exhaust partition (77) into left and right portions. Of the left and right partitioned spaces, the space on the right side of the air-supplying/exhaust partition (77) forms an air-supplying fan chamber (36), and the space on the left side of the air-supplying/exhaust partition (77) forms an exhaust fan chamber (35). The air-supplying/exhaust partition (77) is provided upright further toward the second side surface panel portion (15) with respect to the center partition (73). The air-supplying fan chamber (36) and the exhaust fan chamber (35) are each a space extending from the bottom plate to the top plate of the casing (11).

An air-supplying fan (26) is accommodated in the air-supplying fan chamber (36). An exhaust fan (25) is accommodated in the exhaust fan chamber (35). The air-supplying fan (26) and the exhaust fan (25) are each a centrifugal-type multi-blade fan (so-called a "sirocco fan").

Specifically, these fans (25, 26) each include a fan rotor, a fan casing (86) and a fan motor (89). Although not shown in the figures, a fan rotor is formed in a cylindrical shape whose axial length is shorter than the diameter, with many blades formed on the circumferential surface thereof. The fan rotor is accommodated in the fan casing (86). An inlet port (87) is opened in one of the side surfaces (side surfaces that are perpendicular to the axial direction of the fan rotor) of the fan casing (86). The fan casing (86) is formed with a portion outwardly protruding from the circumferential surface thereof, with an outlet port (88) being opened at the protruding tip of that portion. The fan motor (89) is attached to a side surface of the fan casing (86) that is opposite to the inlet port (87). The fan motor (89) is connected to the fan rotor to rotate the fan rotor.

In the air-supplying fan (26) and the exhaust fan (25), when the fan rotor is rotated by the fan motor (89), the air is sucked into the fan casing (86) through the inlet port (87), and the air in the fan casing (86) is blown out of the outlet port (88).

In the air-supplying fan chamber (36), the air-supplying fan (26) is placed in an orientation such that the inlet port (87) of the fan casing (86) is facing the downstream-side partition (72). The outlet port (88) of the fan casing (86) of the air-supplying fan (26) is attached to the first side surface panel portion (14) in a state where it communicates with the air-supplying port (22).

In the exhaust fan chamber (35), the exhaust fan (25) is placed in an orientation such that the inlet port (87) of the fan casing (86) is facing the downstream-side partition (72). The outlet port (88) of the fan casing (86) of the exhaust fan (25) is attached to the second side surface panel portion (15) in a state where it communicates with the exhaust port (21).

The compressor (53) and the four-way switching valve (54) of the refrigerant circuit (50) are accommodated in the air-supplying fan chamber (36). The compressor (53) and the four-way switching valve (54) are placed between the air-supplying fan (26) in the air-supplying fan chamber (36) and the air-supplying/exhaust partition (77).

In the casing (11), the space between the first partition (74) and the first side surface panel portion (14) forms a first bypass passageway (81) (see FIG. 2, FIG. 3). In the casing (11), the space between the second partition (75) and the second side surface panel portion (15) forms a second bypass passageway (82) (see FIG. 3, FIG. 4). The first bypass passageway (81) and the second bypass passageway (82) are each a space extending from the bottom plate to the top plate of the casing (11). The passageway width of the first bypass passageway (81) is larger than the passageway width of the second bypass passageway (82).

The starting end (the end portion closer to the rear surface panel portion (13)) of the first bypass passageway (81) communicates only with the outside air-side passageway (34) and is blocked from the inside air-side passageway (32). The first bypass passageway (81) communicates with a portion of the outside air-side passageway (34) that is on the downstream side of the outside air-side filter (28). The terminal end (the end portion closer to the front surface panel portion (12)) of the first bypass passageway (81) is separated by a partition (78) from the air-supplying-side passageway (31), the exhaust-side passageway (33) and the air-supplying fan chamber (36). A first bypass damper (83) is provided on a portion of the partition (78) that faces the air-supplying fan chamber (36). The first bypass damper (83) is generally formed in a vertically-oriented rectangular shape. The connection between the first bypass passageway (81) and the air-supplying fan chamber (36) is connected/disconnected as the first bypass damper (83) is opened/closed.

The starting end (the end portion closer to the rear surface panel portion (13)) of the second bypass passageway (82) communicates only with the inside air-side passageway (32), and is blocked from the outside air-side passageway (34). The second bypass passageway (82) communicates with a portion of the inside air-side passageway (32) that is on the downstream side of the inside air-side filter (27) via a communication port (76) formed in the second partition (75). The terminal end (the end portion closer to the front surface panel portion (12)) of the second bypass passageway (82) is separated by a partition (79) from the air-supplying-side passageway (31), the exhaust-side passageway (33) and the exhaust fan chamber (35). A second bypass damper (84) is provided on a portion of the partition (79) that faces the exhaust fan chamber (35). The second bypass damper (84) is generally formed in a vertically-oriented rectangular shape. The connection between the second bypass passageway (82) and the exhaust fan chamber (35) is connected/disconnected as the second bypass damper (84) is opened/closed.

Note that the first bypass passageway (81), the second bypass passageway (82), the first bypass damper (83) and the second bypass damper (84) are not shown in the right side view and the left side view of FIG. 5.

An electrical component box (90) is attached to a portion of the front surface panel portion (12) of the casing (11) closer to the right side. Note that the electrical component box (90) is omitted in FIGS. 2 and 5. The electrical component box (90) is a box of a rectangular parallelepiped shape, and accommodates therein a control substrate (91) and a power supply substrate (92). The control substrate (91) and the power supply substrate (92) are attached to the inner surface of one of the side plates of the electrical component box (90) that is adjacent to the front surface panel portion (12) (i.e., the rear plate). An inverter portion of the power supply substrate (92) is provided with radiator fins (93). The radiator fins (93) are protruding from the rear surface of the power supply substrate (92), and run through the rear plate of the electrical component box (90) and the front surface panel portion (12) of the casing (11) so as to be exposed to the air-supplying fan chamber (36) (see FIG. 3, FIG. 4).

In the casing (11), lead wires connected to the compressor (53), the fans (25, 26), the dampers (41-48), the humidity sensors (96, 97), etc., are extending into the electrical component box (90). Among others, lead wires connected to the drive motors of the dampers (41-44) attached to the upstream-side partition (71) and lead wires connected to the humidity sensors (96, 97) are extending to the electrical component box (90) through the first bypass passageway (81).

A first open/close panel (14*a*), detachable from the casing (11), is formed in the first side surface panel portion (14) of the casing (11). The first open/close panel (14*a*) is formed in an intermediate area of the first side surface panel portion (14) in the longitudinal direction so as to face the first bypass passageway (81). With the first open/close panel (14*a*) removed, the first partition (74) is exposed to the outside of the casing (11) (see FIG. 2). A second open/close panel (74*a*), detachable from the casing (11), is formed in the first partition (74). The second open/close panel (74*a*) is formed in the first partition (74) closer to the rear side so as to face the first heat exchanger chamber (37). With the second open/close panel (74*a*) removed, the first heat exchanger chamber (37) is exposed toward the first bypass passageway (81). As described above, the first open/close panel (14*a*) and the second open/close panel (74*a*) form a maintenance opening, through which the first heat exchanger chamber (37) is exposed to the outside of the casing (11).

<Configuration Of Refrigerant Circuit>

Figure 6:
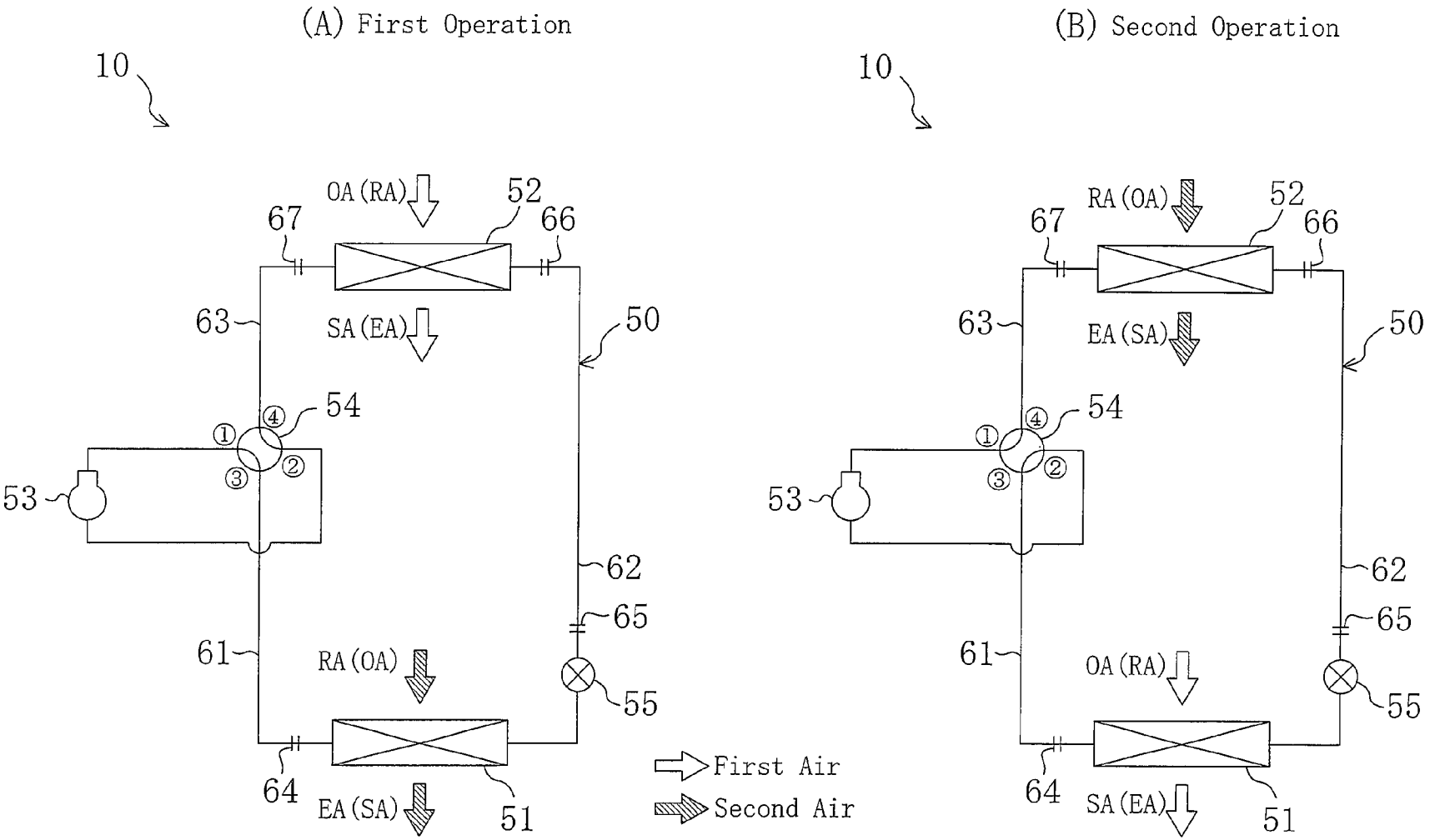
FIG. 6 is a piping diagram showing a configuration of the refrigerant circuit, where (A) shows an operation during the first operation and (B) shows an operation during the second operation.

The refrigerant circuit (50) will be described with reference to FIG. 6. The refrigerant circuit (50) is a closed circuit provided with the first adsorption heat exchanger (51), the second adsorption heat exchanger (52), the compressor (53), the four-way switching valve (54) and the electric expansion valve (55). The refrigerant circuit (50) allows refrigerant, filling the refrigerant circuit (50), to circulate therethrough to perform a vapor-compression refrigeration cycle.

In the refrigerant circuit (50), the compressor (53) has its discharge side connected to the first port of the four-way switching valve (54), and its suction side connected to the second port of the four-way switching valve (54). One end of the first adsorption heat exchanger (51) is connected to the third port of the four-way switching valve (54) via a first connection pipe (61). The other end of the first adsorption heat exchanger (51) is connected to one end of the second adsorption heat exchanger (52) via an intermediate pipe (62). The other end of the second adsorption heat exchanger (52) is connected to the fourth port of the four-way switching valve (54) via a second connection pipe (63).

The first connection pipe (61) forms a gas-side pipe of the first adsorption heat exchanger (51). A first joint member (64) is provided on the first connection pipe (61). The second connection pipe (63) forms a gas-side pipe of the second adsorption heat exchanger (52). A second joint member (67) is provided on the second connection pipe (63). The intermediate pipe (62) forms a liquid-side pipe between the first adsorption heat exchanger (51) and the second adsorption heat exchanger (52). The electric expansion valve (55), a third joint member (65), and a fourth joint member (66) are connected to the intermediate pipe (62) in this order from the side of the first adsorption heat exchanger (51) to the side of the second adsorption heat exchanger (52). Each joint member (64, 65, 66, 67) is a so-called "flare joint," including a joint main body (64*a*, 65*a*, 66*a*, 67*a*) having an external thread portion and a tapered outer circumferential surface formed at the tip of the external thread portion, and a flare nut (64*b*, 65*b*, 66*b*, 67*b*) having internal threads that screw on the joint main body and a tapered inner circumferential surface that comes into close contact with the tapered outer circumferential surface (the details will be described later).

The four-way switching valve (54) can be switched between a first state (the state shown in FIG. 6(A)) in which the first port and the third port communicate with each other and the second port and the fourth port communicate with each other, and a second state (the state shown in FIG. 6(B)) in which the first port and the fourth port communicate with each other and the second port and the third port communicate with each other.

Figure 7:
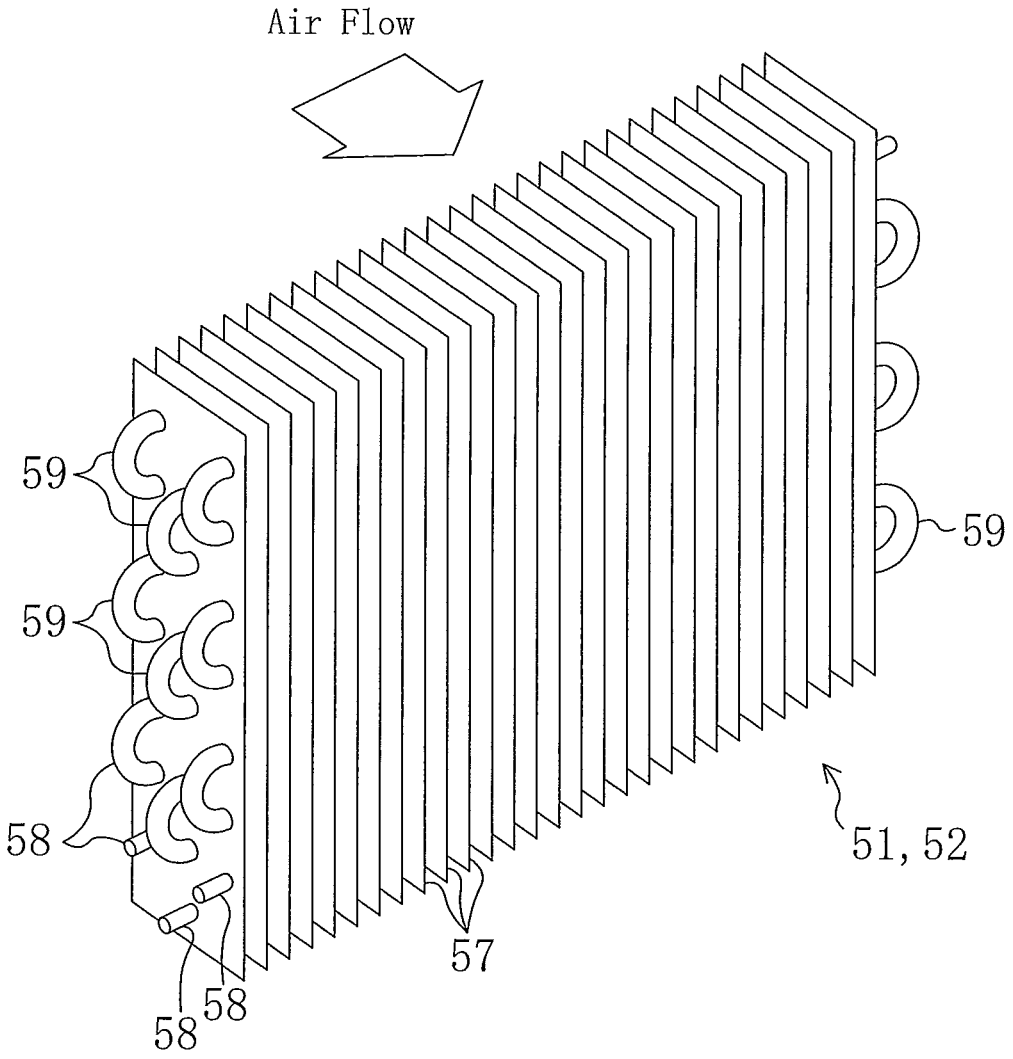
FIG. 7 is a schematic perspective view of an adsorption heat exchanger.

As shown in FIG. 7, the first adsorption heat exchanger (51) and the second adsorption heat exchanger (52) are each formed by a cross-fin-type fin-and-tube heat exchanger. Each adsorption heat exchanger (51, 52) forms humidity controlling means for controlling the humidity of the outside air (OA) or the room air (RA). These adsorption heat exchangers (51, 52) include a copper heat transfer pipe (58) and aluminum fins (57). The plurality of fins (57) provided on the adsorption heat exchanger (51, 52) are each formed in a rectangular plate shape, and are arranged at regular intervals. The heat transfer pipe (58) has a shape meandering in the arrangement direction of the fins (57). That is, the heat transfer pipe (58) includes straight pipe portions running through the fins (57), and U-shaped pipe portions (59), alternating with the straight pipe portions, for connecting adjacent straight pipe portions with each other. In each adsorption heat exchanger (51, 52), tube plates (60), the details of which will be described later, are provided at opposite end portions of each heat transfer pipe (58) in the longitudinal direction. Note that the tube plate (60) is not shown in FIG. 7.

In each adsorption heat exchanger (51, 52), an adsorbent is carried on the surface of each fin (57), and the air passing through between the fins (57) comes into contact with the adsorbent carried on the fins (57). The adsorbent is a material capable of adsorbing the water vapor in the air, e.g., zeolite, silica gel, activated carbon, an organic polymer having a hydrophilic functional group, etc.

In the humidity control apparatus (10) of the present embodiment, the refrigerant circuit (50) forms a heating medium circuit. In the refrigerant circuit (50), a high-pressure gas refrigerant is supplied, as a heating medium fluid for heating, to one of the two adsorption heat exchangers (51, 52) that operates as a condenser, and a low-pressure gas-liquid two-phase refrigerant is supplied, as a heating medium fluid for cooling, to the other that operates as an evaporator.

<Attachment Arrangement Of Adsorption Heat Exchanger>

Next, the details of the attachment arrangement of the adsorption heat exchangers (51, 52) in the heat exchanger chambers (37, 38) will be described.

Each adsorption heat exchanger (51, 52) is provided upright in the corresponding heat exchanger chamber (37, 38) so that the heat transfer pipe (58) thereof extends in the arrangement direction of the heat exchanger chamber (37, 38) (the left-right direction). The adsorption heat exchangers (51, 52) are arranged generally along a straight line in the left-right width direction.

Figure 8:
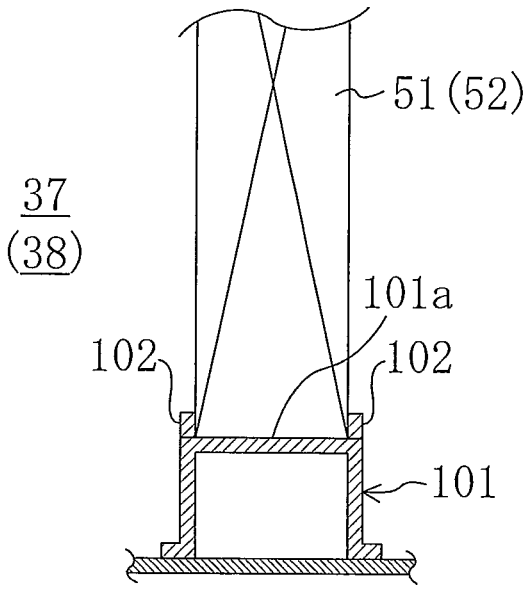
FIG. 8 is a schematic vertical cross-sectional view showing how an adsorption heat exchanger is installed.

As shown in FIG. 8, a base (101) lies under the bottom plate of each heat exchanger chamber (37, 38) so as to extend over these heat exchanger chambers (37, 38). That is, the base (101) is formed so as to extend in the left-right direction from the first partition (74) to the second partition (75). The first adsorption heat exchanger (51) and the second adsorption heat exchanger (52) are placed on a top surface (101*a*) of the base (101). On the top surface of the base (101), a rail member (102) is formed along each of the front end portion and the rear end portion thereof. A pair of rail members (102, 102) extend from the first partition (74) to the second partition (75) in orientations parallel to each other. The adsorption heat exchangers (51, 52) are fit in between the rail members (102, 102). That is, the rail member (102) of the base (101) forms a guide member for slidably guiding the adsorption heat exchangers (51, 52).

Moreover, a so-called "flocked material" made of nylon filament is formed on the surface of the top surface (101*a*) of the base (101). The flocked material makes the sliding of the adsorption heat exchangers (51, 52) smooth, and suppresses the frictional wear of the surface of the base (101).

The first heat exchanger chamber (37) is provided with a first frame member (103) in an upper end portion of the first adsorption heat exchanger (51) on the upstream side (rear side) (see, for example, FIGS. 1 and 4). The first frame member (103) has an L-shaped vertical cross section, and extends from the first partition (74) to the center partition (73). The first frame member (103) is supported by the casing (11) so that one side surface thereof is fixed to the top plate of the casing (11) and the other side surface faces toward the first inside air-side damper (41).

Figure 9:
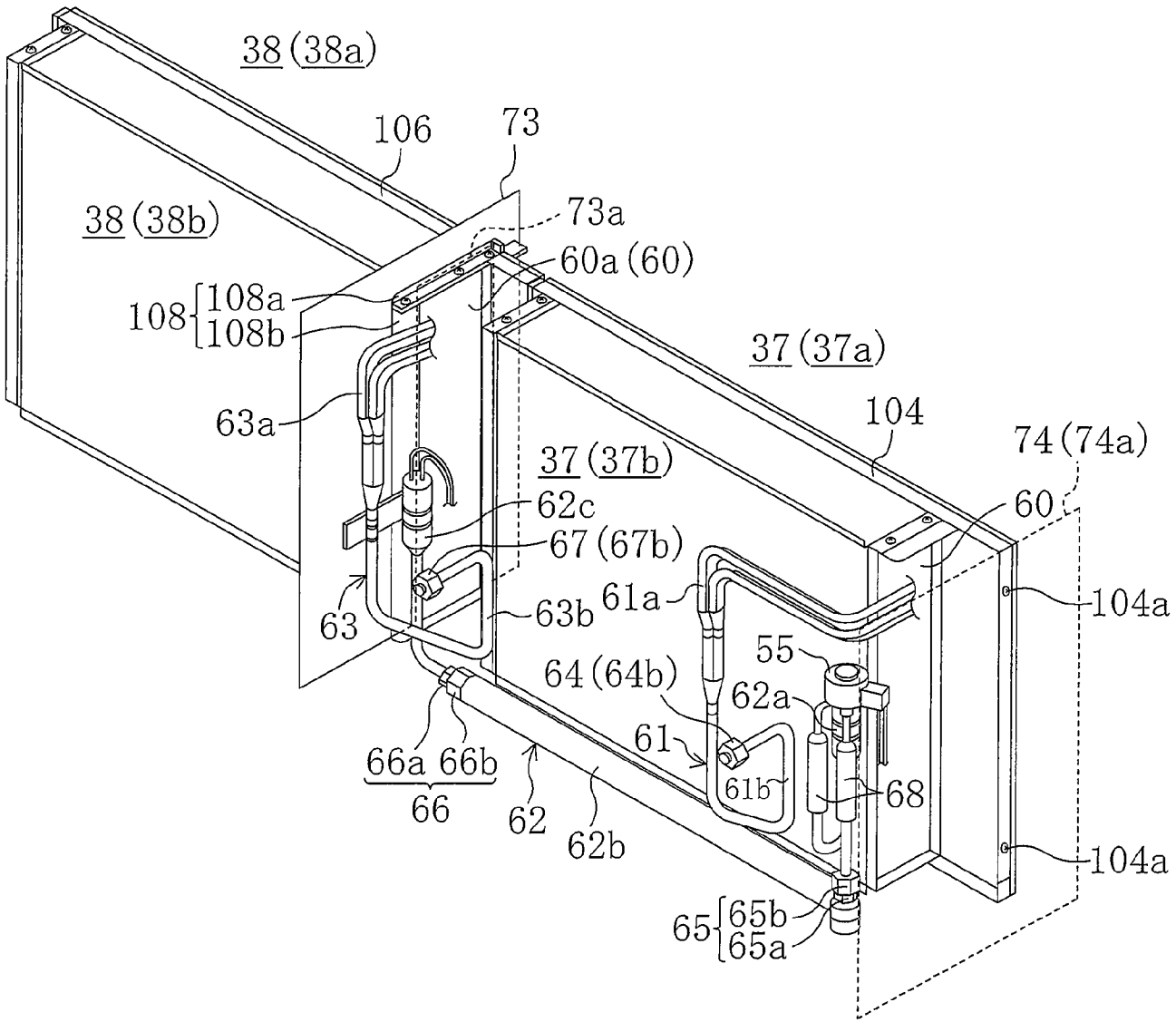
FIG. 9 is a perspective view showing two adsorption heat exchangers, and the attachment arrangement of surrounding piping.

A first framing member (104) is provided near an upstream end of the first adsorption heat exchanger (51) (see, for example, FIGS. 1 and 9). The first framing member (104) is in a generally plate shape that conforms to the upstream side surface of the first adsorption heat exchanger (51), and is formed in a frame shape having an opening through which the air can pass in the front-rear direction. An opening (not shown) is formed in the first framing member (104) such that substantially the entire area of the upstream side surface of the first adsorption heat exchanger (51) is exposed. The upper end portion of the first framing member (104) is substantially in contact with the lower end of the first frame member (103), and the lower end portion of the first framing member (104) is placed on the bottom surface of the casing (11). The right end portion of the first framing member (104) is in contact with the first partition (74), and the first framing member (104) and the first partition (74) are fastened together by two screws (104*a*, 104*a*). On the other hand, the left end portion of the first framing member (104) is located slightly to the right of the center partition (73).

A seal member is formed along the outer periphery portion of the first framing member (104). This suppresses the flow of the air on the upstream side of the first framing member (104) on the outer periphery side thereof, and the air passes through the first adsorption heat exchanger (51) via the opening inside the first framing member (104). The first framing member (104) is fixed integrally with the first adsorption heat exchanger (51). That is, the first framing member (104) is configured to be slidable together with the first adsorption heat exchanger (51).

The second heat exchanger chamber (38) is provided with a second frame member (105) in an upper end portion of the second adsorption heat exchanger (52) on the upstream side (rear side) (see, for example, FIGS. 1 and 4). The second frame member (105) has a C-shaped vertical cross section that is open to the lower side, and is formed so as to extend from the center partition (73) to the second partition (75). The top surface of the second frame member (105) is fixed to the top plate of the casing (11), and the second frame member (105) is supported by the casing (11) so that the upper end portion of the second adsorption heat exchanger (52) is located therein.

Figure 15:
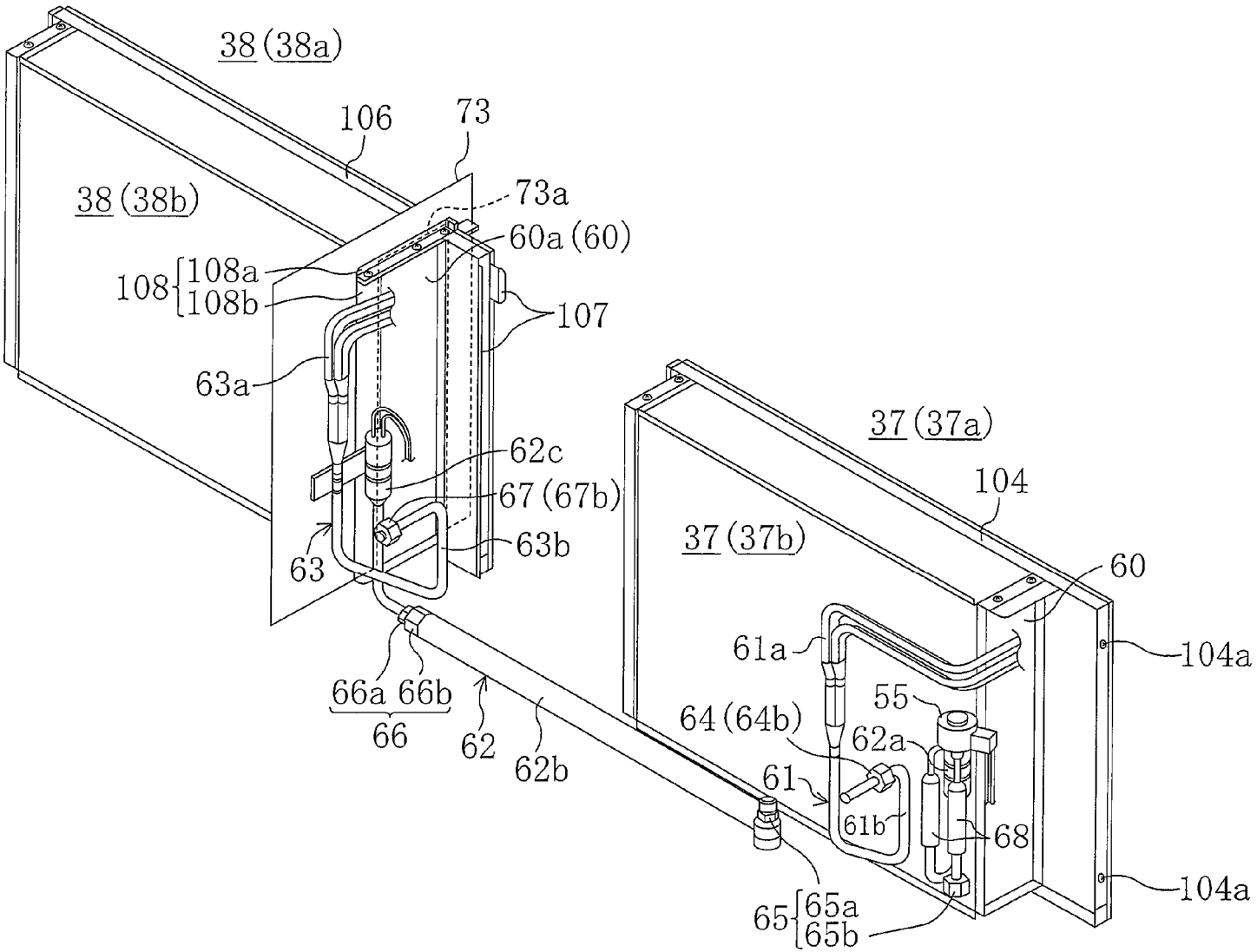
FIG. 15 shows a state where the first adsorption heat exchanger is pulled out from the state in FIG. 9.

A second framing member (106) is provided near an upstream end of the second adsorption heat exchanger (52) (see, for example, FIGS. 1 and 9). The second framing member (106) is in a generally plate shape that conforms to the upstream side surface of the second adsorption heat exchanger (52), and is formed in a frame shape having an opening through which the air can pass in the front-rear direction. An opening (not shown) is formed in the second framing member (106) such that substantially the entire area of the upstream side surface of the second adsorption heat exchanger (52) is exposed. The upper end portion of the second framing member (106) is in contact with the top surface of the second frame member (105), and the lower end portion of the second framing member (106) is placed on the bottom surface of the casing (11). The right end portion of the second framing member (106) runs through a partition opening (73*a*), the details of which will be described later, so as to be in contact with the left end portion of the first framing member (104) (see FIG. 9). Note that a fastening member (107) is provided on the right end portion of the second framing member (106) for clamping and holding the end portion of the first framing member (104) being in contact therewith (see, for example, FIG. 15).

A seal member is formed along the outer periphery portion of the second framing member (106). This suppresses the flow of the air on the upstream side of the second framing member (106) on the outer periphery side thereof, and the air passes through the second adsorption heat exchanger (52) via the opening inside the second framing member (106). The second framing member (106) is fixed integrally with the second adsorption heat exchanger (52). That is, the second framing member (106) is configured to be slidable together with the second adsorption heat exchanger (52).

In the first heat exchanger chamber (37), two, front and rear, spaces are defined by the first framing member (104) and the first adsorption heat exchanger (51). That is, in the first heat exchanger chamber (37), a first upstream-side space (37*a*) is formed on the upstream side of the first adsorption heat exchanger (51), and a first downstream-side space (37*b*) is formed on the downstream side of the first adsorption heat exchanger (51). Similarly, in the second heat exchanger chamber (38), two, front and rear, spaces are defined by the second framing member (106) and the second adsorption heat exchanger (52). That is, in the second heat exchanger chamber (38), a second upstream-side space (38*a*) is formed on the upstream side of the second adsorption heat exchanger (52), and a second downstream-side space (38*b*) is formed on the downstream side of the second adsorption heat exchanger (52).

In each adsorption heat exchanger chamber (37, 38), the length of the width dimension W1 in the air flow direction (front-rear direction) of the corresponding downstream-side space (37*b*, 38*b*) is larger than the length of the width dimension W2 in the air flow direction (front-rear direction) of the corresponding upstream-side space (37*a*, 38*a*) (see FIG. 3). That is, in each adsorption heat exchanger chamber (37, 38), the corresponding adsorption heat exchanger (51, 52) is placed closer to the rear side relative to the center position of the adsorption heat exchanger chamber (37, 38) in the width direction.

The partition opening (73*a*) is formed in the center partition (73) as described above. The partition opening (73*a*) is formed in an area of the center partition (73) that is continuous with the two adsorption heat exchangers (51, 52) in the left-right direction. The partition opening (73*a*) has a shape that conforms to the outline of the outer shape of the second adsorption heat exchanger (52) and the second framing member (106) as the second adsorption heat exchanger (52) and the second framing member (106) are viewed from the side of the first side surface panel portion (14). That is, the partition opening (73*a*) is shaped in a vertically-oriented rectangular shape such that the second framing member (106) and the second adsorption heat exchanger (52) are allowed to pass therethrough. Thus, the second framing member (106) and the second adsorption heat exchanger (52) can be moved between the second heat exchanger chamber (38) and the first heat exchanger chamber (37) through the partition opening (73*a*).

The tube plates (60) for supporting the heat transfer pipe (58) are provided at opposite end portions of the heat transfer pipe (58) in each adsorption heat exchanger (51, 52). Of the tube plates (60), a tube plate (60*a*) on one side of the second adsorption heat exchanger (52) closer to the first side surface panel portion (14) forms a blocking member for blocking the partition opening (73*a*) of the center partition (73). That is, in a normal placement position shown in FIG. 3, for example, the second adsorption heat exchanger (52) is placed in the proximity to the center partition (73). In the second adsorption heat exchanger (52) in this position, the tube plate (60*a*) fits in the partition opening (73*a*) so as to coincide with the center partition (73). As a result, the first heat exchanger chamber (37) and the second heat exchanger chamber (38) are separated from each other by the tube plate (60*a*) of the second adsorption heat exchanger (52) and the center partition (73), thus suppressing the leakage of the air between the heat exchanger chambers (37, 38).

Moreover, a frame-shaped partition member (108) is provided along the outer periphery portion of the tube plate (60*a*) of the second adsorption heat exchanger (52). The frame-shaped partition member (108) includes an upper collar portion (108*a*) formed on the upper end portion of the tube plate (60*a*), and a side collar portion (108*b*) formed along the front-side end portion of the tube plate (60*a*). The upper collar portion (108*a*) has a generally L-shaped vertical cross section, and extends in the front-rear direction. A side (left side) end surface of the upper collar portion (108*a*) is fixed to the tube plate (60*a*). On the other hand, the upper end of the side collar portion (108*b*) is bent sideways, and the bent top surface is fastened via a screw to the lower end surface of the upper collar portion (108*a*). On the other hand, the main body of the side collar portion (108*b*) is formed in a plate shape extending in the vertical direction, and an area thereof closer to the rear side is fixed to the front end portion of tube plate (60*a*). The outer periphery portion of the frame-shaped partition member (108) is located outside of the outer periphery of the tube plate (60*a*). That is, the frame-shaped partition member (108) has such a shape that the upper end portion and the front end portion of the tube plate (60*a*) are extended outwardly so as to be expanded. The heat transfer pipe (58) and the U-shaped pipe portion (59), running through the tube plate (60*a*), are located inside the frame-shaped partition member (108) (the heat transfer pipe and the U-shaped pipe portion are not shown in FIG. 9).

The frame-shaped partition member (108) is attached to the tube plate (60*a*) so as to face the first heat exchanger chamber (37). That is, the frame-shaped partition member (108) is fixed, from the side of the first heat exchanger chamber (37), to the tube plate (60*a*) being inserted through the partition opening (73*a*). In a normal placement position of the second adsorption heat exchanger (52), the frame-shaped partition member (108) comes into contact with the outer periphery portion of the partition opening (73*a*) on the right surface of the center partition (73). As a result, the contact portion forms a seal portion that seals the gap between the partition opening (73*a*) and the tube plate (60*a*). With the frame-shaped partition member (108) being in contact with the center partition (73) as described above, the second adsorption heat exchanger (52), which is integral with the frame-shaped partition member (108), is prevented from moving further in the depth direction (toward the second side surface panel portion (15)) relative to the normal placement position of FIG. 3. That is, the frame-shaped partition member (108) serves also as a positioning member for positioning the second adsorption heat exchanger (52). Note that it is preferred that a predetermined seal member is provided at a contact portion between the frame-shaped partition member (108) and the center partition (73). Then, it is possible to more effectively suppress the leakage of the air between the heat exchanger chambers (37, 38).

<Attachment Arrangement Around Adsorption Heat Exchanger>

Next, refrigerant pipes around the two adsorption heat exchangers (51, 52) and the attachment arrangement of components to be attached to the refrigerant pipes will be described with reference to FIGS. 3, 6 and 9. In the present embodiment, refrigerant pipes around the adsorption heat exchangers (51, 52) and components to be attached to the refrigerant pipes are provided so that they are all put together in the first heat exchanger chamber (37).

One end of the first connection pipe (61) as a gas-side pipe is connected to the first adsorption heat exchanger (51). The first connection pipe (61) includes a first gas-side header (61*a*), a first inner pipe (61*b*), and a first outer pipe (61*c*).

The distribution pipe of the first gas-side header (61*a*) is connected to an end portion of the first adsorption heat exchanger (51) that is on the right side (the side of the first side surface panel portion). The junction pipe side of the first gas-side header (61*a*) is bent so as to conform to the upper front surface of the first adsorption heat exchanger (51) and is then bent downward. One end of the first inner pipe (61*b*) is connected to the lower end portion of the junction pipe of the first gas-side header (61*a*). The other end portion of the first inner pipe (61*b*) is bent rightward, upward and then frontward. A flare nut (64*b*) of the first joint member (64) is attached to the other end portion of the first inner pipe (61*b*). On the other hand, a joint main body (64*a*) of the first joint member (64) faces the first heat exchanger chamber (37), running through the downstream-side partition (72) (see FIG. 3). Thus, the first joint member (64) is placed closer to the first side surface panel portion (14) in the first heat exchanger chamber (37), where the flare nut (64*b*) and the joint main body (64*a*) can be connected together.

On the other hand, the first outer pipe (61*c*), which is connected to the joint main body (64*a*) of the first joint member (64), is provided in the air-supplying fan chamber (36) (see FIG. 3). The terminal end of the first outer pipe (61*c*) is connected to the four-way switching valve (54).

One end of the second connection pipe (63) as a gas-side pipe is connected to the second adsorption heat exchanger (52). The second connection pipe (63) includes a second gas-side header (63*a*), a second inner pipe (63*b*), and a second outer pipe (63*c*).

The distribution pipe of the second gas-side header (63*a*) is connected to an end portion of the second adsorption heat exchanger (52) that is on the right side (the side of the first side surface panel portion). That is, in the second adsorption heat exchanger (52), the tube plate (60*a*) on the right side is exposed to the side of the first heat exchanger chamber (37) through the partition opening (73*a*) described above. Therefore, the distribution pipe of the second gas-side header (63*a*) is connected to the second adsorption heat exchanger (52), running through the partition opening (73*a*). The junction pipe side of the second gas-side header (63*a*) extends downward from a position closer to the upper portion of the second adsorption heat exchanger (52). One end of the second inner pipe (63*b*) is connected to the lower end portion of the junction pipe of the second gas-side header (63*a*). The other end portion of the second inner pipe (63*b*) is bent rightward, upward and then frontward. A flare nut (67*b*) of the second joint member (67) is attached to the other end portion of the second inner pipe (63*b*). On the other hand, a joint main body (67*a*) of the second joint member (67) faces the first heat exchanger chamber (37), running through the downstream-side partition (72) (see FIG. 3). Thus, the second joint member (67) is placed closer to the center partition (73) (opposite to the first side surface panel portion) in the first heat exchanger chamber (37), where the flare nut (67*b*) and the joint main body (67*a*) can be connected together.

On the other hand, the second outer pipe (63*c*), which is connected to the joint main body (67*a*) of the second joint member (67), is provided in the air-supplying fan chamber (36) (see FIG. 3). The terminal end of the second outer pipe (63*c*) is connected to the four-way switching valve (54).

The first adsorption heat exchanger (51) and the second adsorption heat exchanger (52) are connected to each other by the intermediate pipe (62). The intermediate pipe (62) includes a first liquid-side distributor (62*a*), a straight pipe (62*b*), and a second liquid-side distributor (62*c*).

The distribution pipe of the first liquid-side distributor (62*a*) is connected to the right end portion of the first adsorption heat exchanger (51). The electric expansion valve (55) is connected to the junction pipe side of the first liquid-side distributor (62*a*). Refrigerant pipes near the upstream side and near the downstream side of the electric expansion valve (55) are provided with filters (68, 68) for removing impurities in the refrigerant. The junction pipe of the first liquid-side distributor (62*a*) extends downward, with a flare nut (65*b*) of the third joint member (65) attached to the lower end portion thereof.

The distribution pipe of the second liquid-side distributor (62*c*) is connected to the right end portion of the second adsorption heat exchanger (52). As with the second gas-side header (63*a*) described above, the second liquid-side distributor (62*c*) is connected to the second adsorption heat exchanger (52), running through the partition opening (73*a*) of the center partition (73). The junction pipe side of the second liquid-side distributor (62*c*) extends downward and is then bent to the right. A joint main body (66*a*) of the fourth joint member (66) is attached to the bent area.

The straight pipe (62*b*) extends in the left-right direction so as to conform to the bottom surface of the first heat exchanger chamber (37). That is, the straight pipe (62*b*) extends along a straight line from the first partition (74) to the center partition (73). The straight pipe (62*b*) is wrapped around with a heat-insulating material, or the like. A joint main body (65*a*) of the third joint member (65) is attached to one end portion of the straight pipe (62*b*) on the right. Thus, the third joint member (65) is placed closer to the first side surface panel portion (14) in the first heat exchanger chamber (37), where the flare nut (65*b*) and the joint main body (65*a*) can be connected together. On the other hand, a flare nut (66*b*) of the fourth joint member (66) is attached to the other end portion of the straight pipe (62*b*) on the left. Thus, the fourth joint member (66) is placed closer to the center partition (73) (opposite to the first side surface panel portion) in the first heat exchanger chamber (37), where the flare nut (66*b*) and the joint main body (66*a*) can be connected together.

With such a configuration, the first adsorption heat exchanger (51) and the second adsorption heat exchanger (52) can be separately removed from the refrigerant circuit (50). That is, the first adsorption heat exchanger (51) can be removed from the refrigerant circuit (50) by disconnecting the first joint member (64) and the third joint member (65). The second adsorption heat exchanger (52) can be removed from the refrigerant circuit (50) by disconnecting the second joint member (67) and the fourth joint member (66). Moreover, in the refrigerant circuit (50), the straight pipe (62*b*) between the third joint member (65) and the fourth joint member (66) can also be removed by disconnecting the joint members (65, 66).

—Operating Modes—

The humidity control apparatus (10) of the present embodiment selectively performs one of a dehumidifying ventilation mode, a humidifying ventilation mode and a simple ventilation mode. The humidity control apparatus (10) in the dehumidifying ventilation mode or the humidifying ventilation mode controls the humidity of the received outside air (OA) and then supplies the air into the room as the supply air (SA)

while simultaneously discharging the received room air (RA) to the outside as the exhaust air (EA). On the other hand, the humidity control apparatus (10) in the simple ventilation mode supplies the received outside air (OA) as it is into the room as the supply air (SA) while simultaneously discharging the received room air (RA) as it is to the outside as the exhaust air (EA).

<Dehumidifying Ventilation Mode>

The humidity control apparatus (10) in the dehumidifying ventilation mode performs a first operation and a second operation, which will be described later, alternately with each other at intervals of a predetermined period (e.g., at intervals of 3 min). In the dehumidifying ventilation mode, the first bypass damper (83) and the second bypass damper (84) are always closed.

In the humidity control apparatus (10) in the dehumidifying ventilation mode, when the air-supplying fan (26) is operated, the outside air is taken into the casing (11) through the outside air inlet port (24) as the first air. When the exhaust fan (25) is operated, the room air is taken into the casing (11) through the inside air inlet port (23) as the second air.

Figure 10:
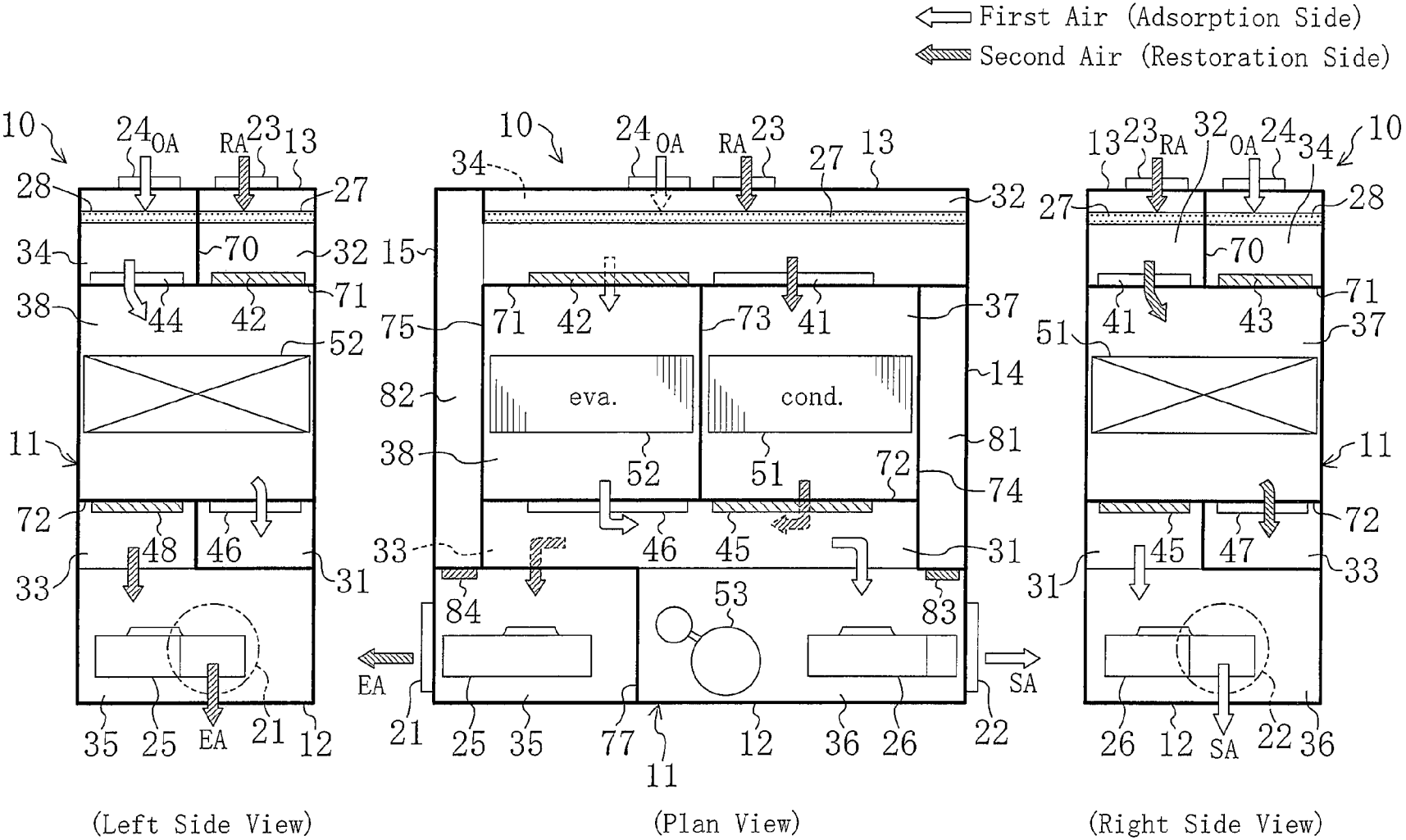
FIG. 10 shows a schematic plan view, a right side view and a left side view of the humidity control apparatus showing the flow of the air in the first operation of the dehumidifying ventilation mode.

First, the first operation of the dehumidifying ventilation mode will be described. As shown in FIG. 10, in the first operation, the first inside air-side damper (41), the second outside air-side damper (44), the second air-supplying-side damper (46) and the first exhaust-side damper (47) are open, and the second inside air-side damper (42), the first outside air-side damper (43), the first air-supplying-side damper (45) and the second exhaust-side damper (48) are closed.

In the refrigerant circuit (50) in the first operation, the four-way switching valve (54) is set in the first state as shown in FIG. 6(A). Refrigerant circulates through the refrigerant circuit (50) in this state to perform a refrigeration cycle. In this process, in the refrigerant circuit (50), the refrigerant discharged from the compressor (53) passes through the first adsorption heat exchanger (51), the electric expansion valve (55) and then the second adsorption heat exchanger (52), where the first adsorption heat exchanger (51) serves as the condenser and the second adsorption heat exchanger (52) serves as the evaporator.

The first air, which has passed through the outside air-side filter (28) flowing into the outside air-side passageway (34), flows into the second heat exchanger chamber (38) through the second outside air-side damper (44), and then passes through the second adsorption heat exchanger (52). In the second adsorption heat exchanger (52), the moisture of the first air is adsorbed by the adsorbent, with the resulting heat of adsorption being absorbed by the refrigerant. The first air, which has been dehumidified through the second adsorption heat exchanger (52), flows into the air-supplying-side passageway (31) through the second air-supplying-side damper (46), and is supplied into the room through the air-supplying port (22) after passing through the air-supplying fan chamber (36).

On the other hand, the second air, which has passed through the inside air-side filter (27) flowing into the inside air-side passageway (32), flows into the first heat exchanger chamber (37) through the first inside air-side damper (41), and then passes through the first adsorption heat exchanger (51). In the first adsorption heat exchanger (51), the moisture is desorbed from the adsorbent heated by the refrigerant, and the desorbed moisture is given to the second air. The second air, which has been given the moisture through the first adsorption heat exchanger (51), flows into the exhaust-side passageway (33) through the first exhaust-side damper (47), and is discharged to the outside through the exhaust port (21) after passing through the exhaust fan chamber (35).

Figure 11:
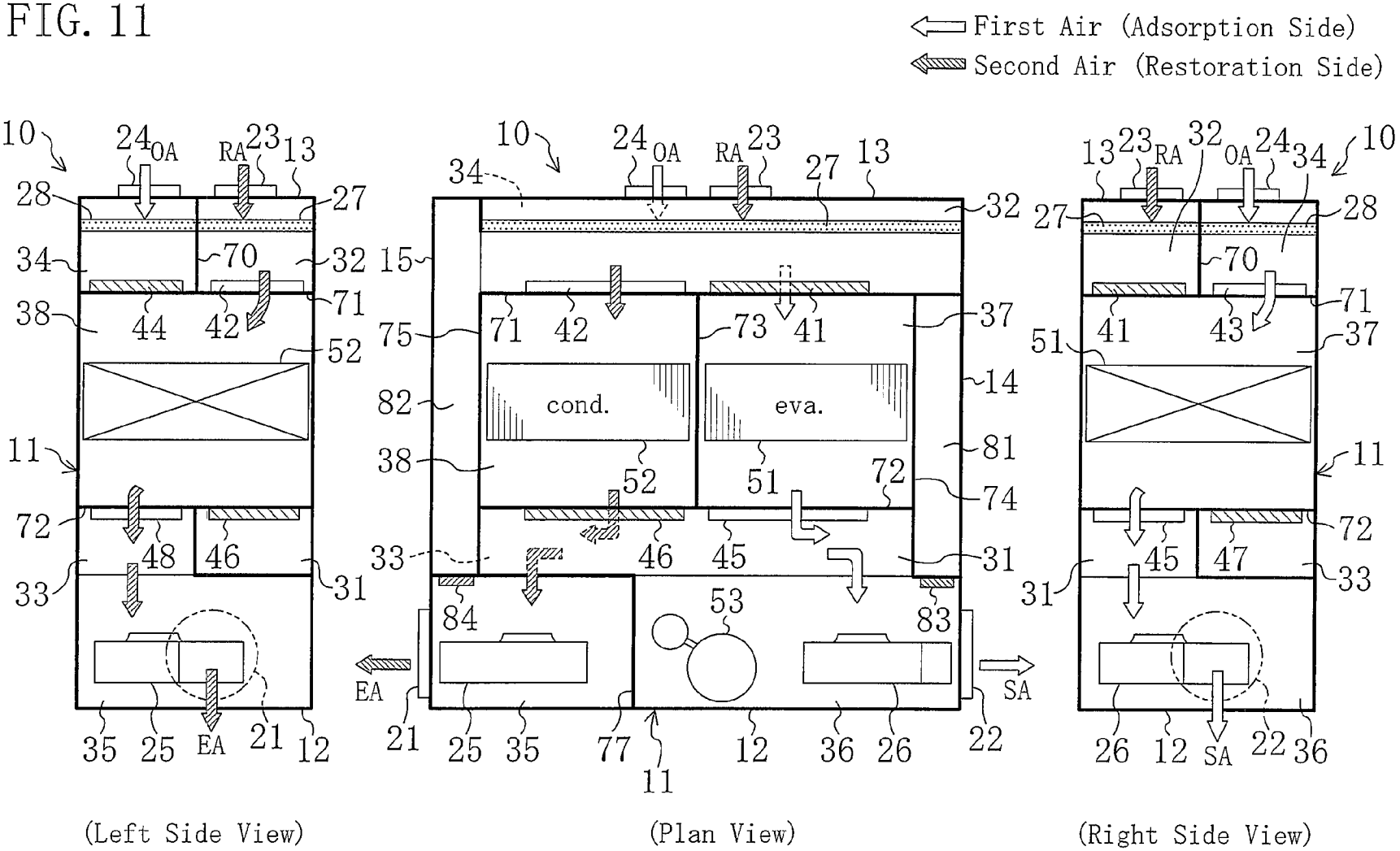
FIG. 11 shows a schematic plan view, a right side view and a left side view of the humidity control apparatus showing the flow of the air in the second operation of the dehumidifying ventilation mode.

Next, the second operation in the dehumidifying ventilation mode will be described. As shown in FIG. 11, in the second operation, the second inside air-side damper (42), the first outside air-side damper (43), the first air-supplying-side damper (45) and the second exhaust-side damper (48) are open, and the first inside air-side damper (41), the second outside air-side damper (44), the second air-supplying-side damper (46) and the first exhaust-side damper (47) are closed.

In the refrigerant circuit (50) in the second operation, the four-way switching valve (54) is set in the second state as shown in FIG. 6(B). Refrigerant circulates through the refrigerant circuit (50) in this state to perform a refrigeration cycle. In this process, in the refrigerant circuit (50), the refrigerant discharged from the compressor (53) passes through the second adsorption heat exchanger (52), the electric expansion valve (55) and then the first adsorption heat exchanger (51), where the first adsorption heat exchanger (51) serves as the evaporator and the second adsorption heat exchanger (52) serves as the condenser.

The first air, which has passed through the outside air-side filter (28) flowing into the outside air-side passageway (34), flows into the first heat exchanger chamber (37) through the first outside air-side damper (43), and then passes through the first adsorption heat exchanger (51). In the first adsorption heat exchanger (51), the moisture of the first air is adsorbed by the adsorbent, with the resulting heat of adsorption being absorbed by the refrigerant. The first air, which has been dehumidified through the first adsorption heat exchanger (51), flows into the air-supplying-side passageway (31) through the first air-supplying-side damper (45), and is supplied into the room through the air-supplying port (22) after passing through the air-supplying fan chamber (36).

On the other hand, the second air, which has passed through the inside air-side filter (27) flowing into the inside air-side passageway (32), flows into the second heat exchanger chamber (38) through the second inside air-side damper (42), and then passes through the second adsorption heat exchanger (52). In the second adsorption heat exchanger (52), the moisture is desorbed from the adsorbent heated by the refrigerant, and the desorbed moisture is given to the second air. The second air, which has been given the moisture through the second adsorption heat exchanger (52), flows into the exhaust-side passageway (33) through the second exhaust-side damper (48), and is discharged to the outside through the exhaust port (21) after passing through the exhaust fan chamber (35).

<Humidifying Ventilation Mode>

The humidity control apparatus (10) in the humidifying ventilation mode performs a first operation and a second operation, which will be described later, alternately with each other at intervals of a predetermined period (e.g., at intervals of 3 min). In the humidifying ventilation mode, the first bypass damper (83) and the second bypass damper (84) are always closed.

In the humidity control apparatus (10) in the humidifying ventilation mode, when the air-supplying fan (26) is operated, the outside air is taken into the casing (11) through the outside air inlet port (24) as the second air. When the exhaust fan (25) is operated, the room air is taken into the casing (11) through the inside air inlet port (23) as the first air.

Figure 12:
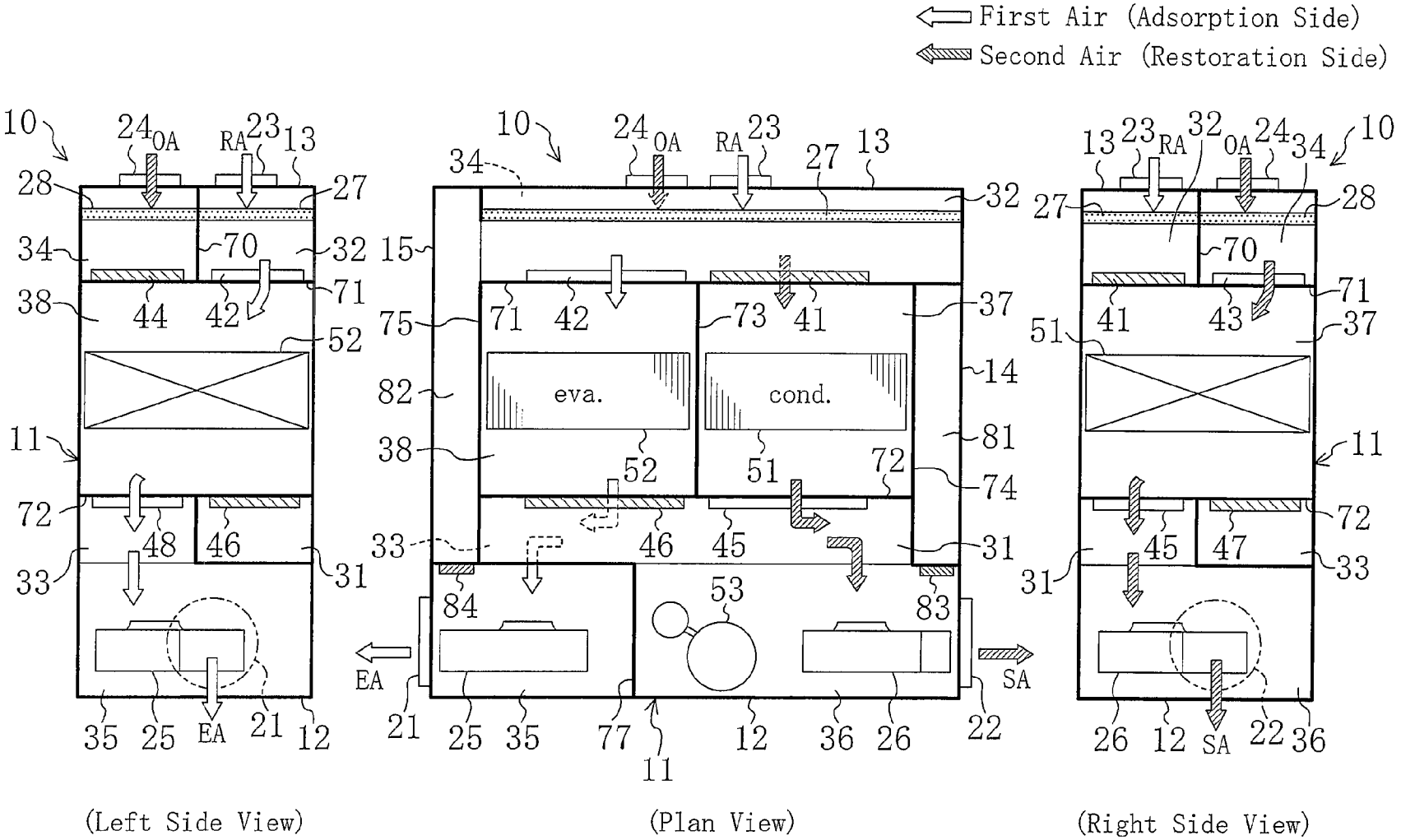
FIG. 12 shows a schematic plan view, a right side view and a left side view of the humidity control apparatus showing the flow of the air in the first operation of the humidifying ventilation mode.

First, the first operation of the humidifying ventilation mode will be described. As shown in FIG. 12, in the first operation, the second inside air-side damper (42), the first outside air-side damper (43), the first air-supplying-side damper (45) and the second exhaust-side damper (48) are open, and the first inside air-side damper (41), the second outside air-side damper (44), the second air-supplying-side damper (46) and the first exhaust-side damper (47) are closed.

In the refrigerant circuit (50) in the first operation, the four-way switching valve (54) is set in the first state as shown in FIG. 6(A). In the refrigerant circuit (50), the first adsorption heat exchanger (51) serves as the condenser and the second adsorption heat exchanger (52) serves as the evaporator, as in the first operation of the dehumidifying ventilation mode.

The first air, which has passed through the inside air-side filter (27) flowing into the inside air-side passageway (32), flows into the second heat exchanger chamber (38) through the second inside air-side damper (42), and then passes through the second adsorption heat exchanger (52). In the second adsorption heat exchanger (52), the moisture of the first air is adsorbed by the adsorbent, with the resulting heat of adsorption being absorbed by the refrigerant. The first air, which has been deprived of the moisture through the second adsorption heat exchanger (52), flows into the exhaust-side passageway (33) through the second exhaust-side damper (48), and is discharged to the outside through the exhaust port (21) after passing through the exhaust fan chamber (35).

On the other hand, the second air, which has passed through the outside air-side filter (28) flowing into the outside air-side passageway (34), flows into the first heat exchanger chamber (37) through the first outside air-side damper (43), and then passes through the first adsorption heat exchanger (51). In the first adsorption heat exchanger (51), the moisture is desorbed from the adsorbent heated by the refrigerant, and the desorbed moisture is given to the second air. The second air, which has been humidified through the first adsorption heat exchanger (51), flows into the air-supplying-side passageway (31) through the first air-supplying-side damper (45), and is supplied into the room through the air-supplying port (22) after passing through the air-supplying fan chamber (36).

Figure 13:
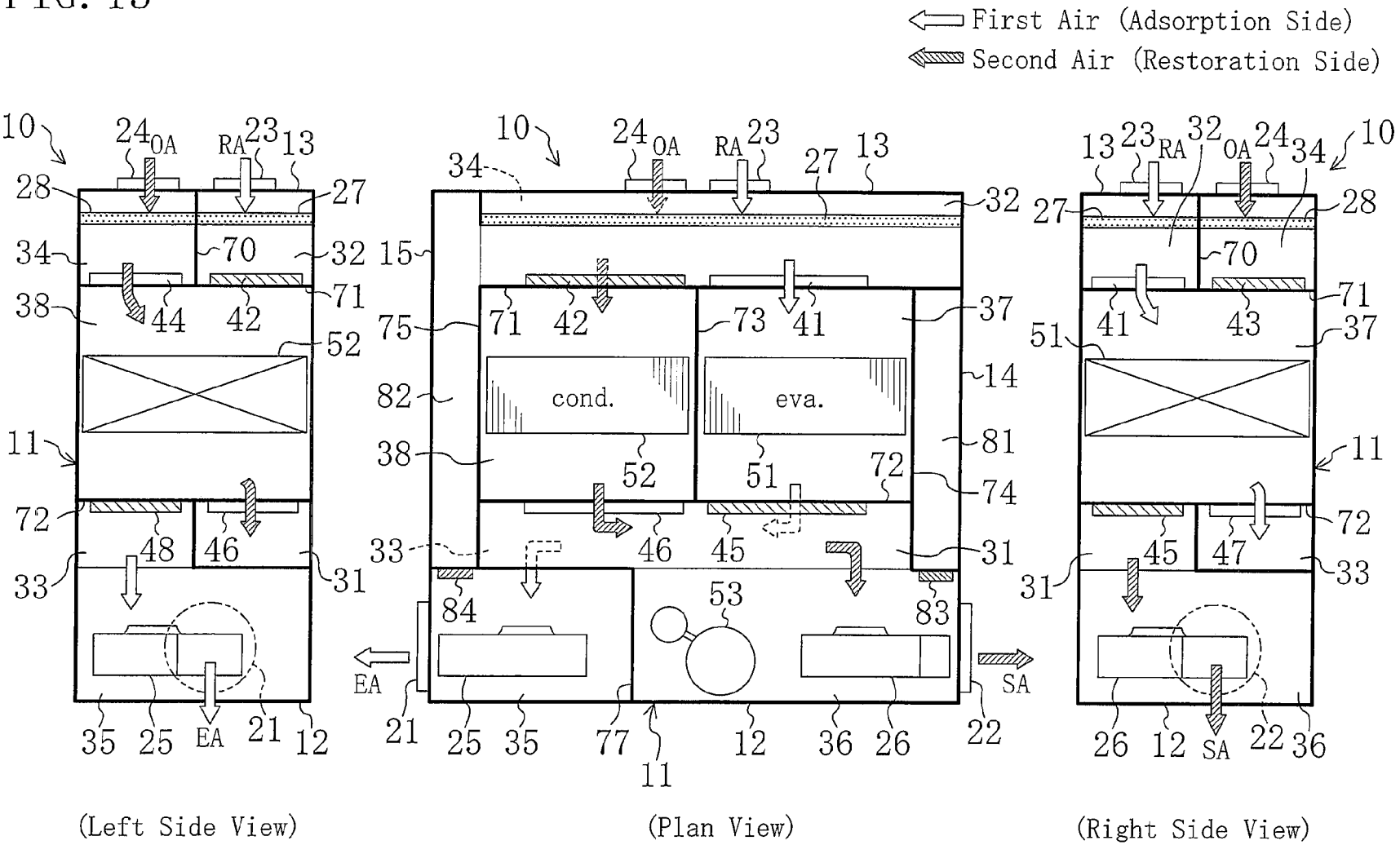
FIG. 13 shows a schematic plan view, a right side view and a left side view of the humidity control apparatus showing the flow of the air in the second operation of the humidifying ventilation mode.

Next, the second operation in the humidifying ventilation mode will be described. As shown in FIG. 13, in the second operation, the first inside air-side damper (41), the second outside air-side damper (44), the second air-supplying-side damper (46) and the first exhaust-side damper (47) are open, and the second inside air-side damper (42), the first outside air-side damper (43), the first air-supplying-side damper (45) and the second exhaust-side damper (48) are closed.

In the refrigerant circuit (50) in the second operation, the four-way switching valve (54) is set in the second state as shown in FIG. 6(B). In the refrigerant circuit (50), the first adsorption heat exchanger (51) serves as the evaporator and the second adsorption heat exchanger (52) serves as the condenser, as in the second operation of the dehumidifying ventilation mode.

The first air, which has passed through the inside air-side filter (27) flowing into the inside air-side passageway (32), flows into the first heat exchanger chamber (37) through the first inside air-side damper (41), and then passes through the first adsorption heat exchanger (51). In the first adsorption heat exchanger (51), the moisture of the first air is adsorbed by the adsorbent, with the resulting heat of adsorption being absorbed by the refrigerant. The first air, which has been deprived of the moisture through the first adsorption heat exchanger (51), flows into the exhaust-side passageway (33) through the first exhaust-side damper (47), and is discharged to the outside through the exhaust port (21) after passing through the exhaust fan chamber (35).

On the other hand, the second air, which has passed through the outside air-side filter (28) flowing into the outside air-side passageway (34), flows into the second heat exchanger chamber (38) through the second outside air-side damper (44), and then passes through the second adsorption heat exchanger (52). In the second adsorption heat exchanger (52), the moisture is desorbed from the adsorbent heated by the refrigerant, and the desorbed moisture is given to the second air. The second air, which has been humidified through the second adsorption heat exchanger (52), flows into the air-supplying-side passageway (31) through the second air-supplying-side damper (46), and is supplied into the room through the air-supplying port (22) after passing through the air-supplying fan chamber (36).

<Simple Ventilation Mode>

Figure 14:
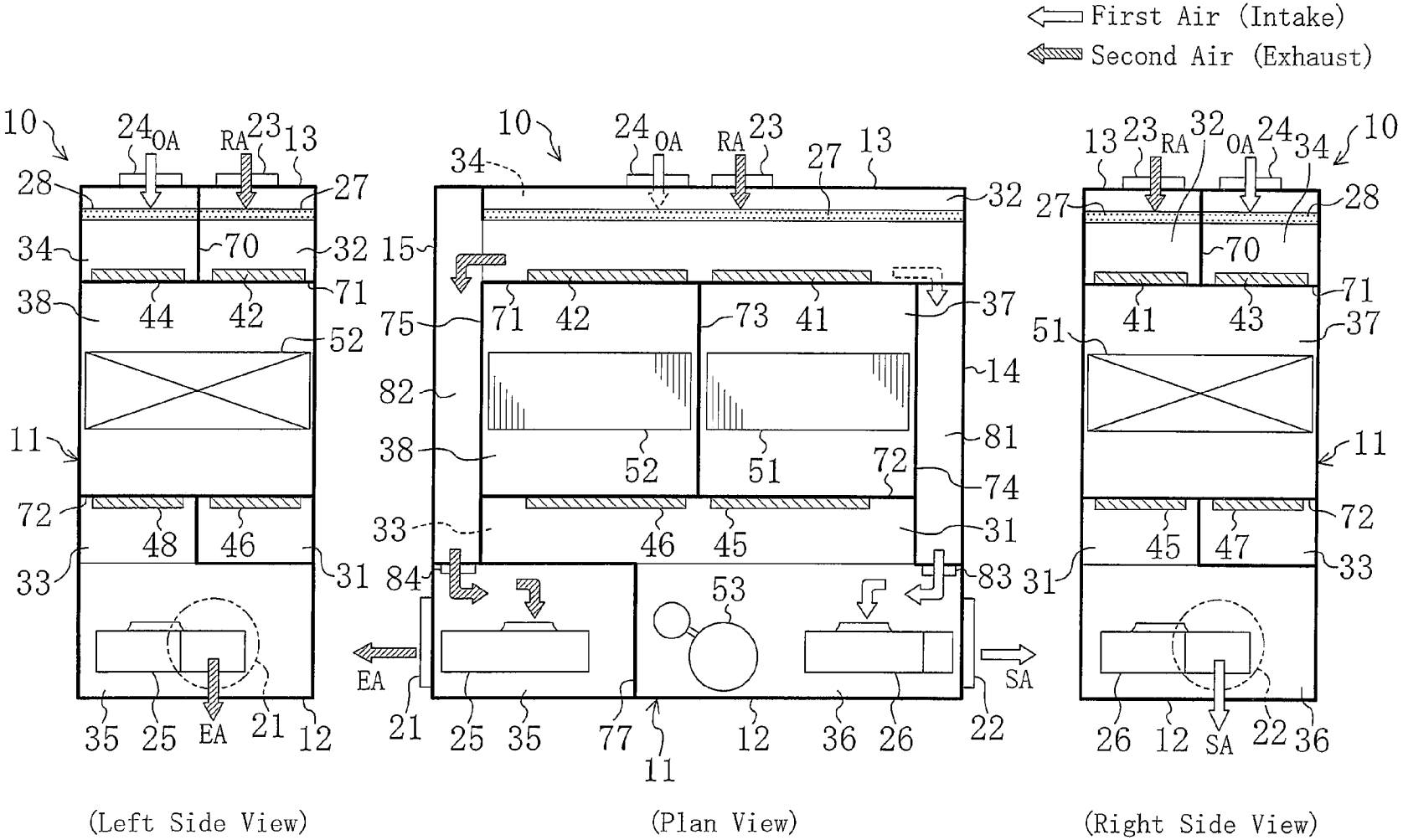
FIG. 14 shows a schematic plan view, a right side view and a left side view of the humidity control apparatus showing the flow of the air in the simple ventilation mode.

The operation of the humidity control apparatus (10) in the simple ventilation mode will be described with reference to FIG. 14. The simple ventilation mode is performed in a season (e.g., an in-between season such as spring or fall) when the room is kept comfortable even if the outside air is supplied as it is into the room. That is, the simple ventilation mode is performed when it is not necessary to control the humidity of the air supplied into the room but it is necessary to ventilate the room.

In the simple ventilation mode, the first bypass damper (83) and the second bypass damper (84) are open, and the first inside air-side damper (41), the second inside air-side damper (42), the first outside air-side damper (43), the second outside air-side damper (44), the first air-supplying-side damper (45), the second air-supplying-side damper (46), the first exhaust-side damper (47) and the second exhaust-side damper (48) are closed. In the simple ventilation mode, the compressor (53) of the refrigerant circuit (50) is shut down. That is, in the simple ventilation mode, the refrigeration cycle in the refrigerant circuit (50) is not performed.

In the humidity control apparatus (10) in the simple ventilation mode, when the air-supplying fan (26) is operated, the outside air is taken into the casing (11) through the outside air inlet port (24). The outside air, which has passed through the outside air inlet port (24) flowing into the outside air-side passageway (34), flows into the first bypass passageway (81) after passing through the outside air-side filter (28), and then flows into the air-supplying fan chamber (36) through the first bypass damper (83). The outside air, which has flown into the air-supplying fan chamber (36), is sucked into the air-supplying fan (26), and is supplied into the room through the air-supplying port (22).

In the humidity control apparatus (10) in the simple ventilation mode, when the exhaust fan (25) is operated, the room air is taken into the casing (11) through the inside air inlet port (23). The room air, which has passed through the inside air inlet port (23) flowing into the inside air-side passageway (32), flows into the second bypass passageway (82) after passing through the inside air-side filter (27), and then flows into the exhaust fan chamber (35) through the second bypass damper (84). The room air, which has flown into the exhaust fan chamber (35), is sucked into the exhaust fan (25), and is discharged to the outside through the exhaust port (21).

—Regarding Maintenance Operation for Adsorption Heat Exchanger—

Next, the maintenance operation for the two adsorption heat exchangers (51, 52) and that for refrigerant pipes and components connected around the adsorption heat exchangers (51, 52) will be described.

When maintaining the adsorption heat exchangers (51, 52), the first open/close panel (14*a*) of the first side surface panel portion (14) shown in FIG. 1, for example, is opened. As a result, the first bypass passageway (81) is exposed to the outside of the casing (11) (see FIG. 2). Then, the second open/close panel (74*a*) of the first partition (74) is opened. As a result, the inside of the first heat exchanger chamber (37) is exposed to the outside of the casing (11). In this process, two screws (104*a*, 104*a*), fastening together the first partition (74) and the first framing member (104), are removed. Thus, the fixing of the first framing member (104) to the casing (11) is completely removed.

Then, the operation of removing the first adsorption heat exchanger (51) from the refrigerant circuit (50) is performed. Specifically, in such a state as shown in FIG. 9, the third joint member (65), which is placed so as to face the first side surface panel portion (14), is disconnected. The first joint member (64), which is placed so as to face the first side surface panel portion (14), is also disconnected. As a result, the first adsorption heat exchanger (51) can be moved off the refrigerant circuit (50).

The first adsorption heat exchanger (51) in this state is pulled out toward the first side surface panel portion (14) along the rail members (102, 102) described above. When the first adsorption heat exchanger (51) is slid, components integrated with the first adsorption heat exchanger (51) also move together with the first adsorption heat exchanger (51) (see FIG. 15). Specifically, components that move integrally with the first adsorption heat exchanger (51) include the first framing member (104), the first gas-side header (61*a*), the first inner pipe (61*b*), the flare nut (64*b*) of the first joint member (64), the first liquid-side distributor (62*a*), the electric expansion valve (55), the filters (68, 68), the flare nut (65*b*) of the third joint member (65), etc. As described above, by pulling out the first adsorption heat exchanger (51) and other components integrated therewith to the outside of the casing (11), they can be maintained.

Figure 16:
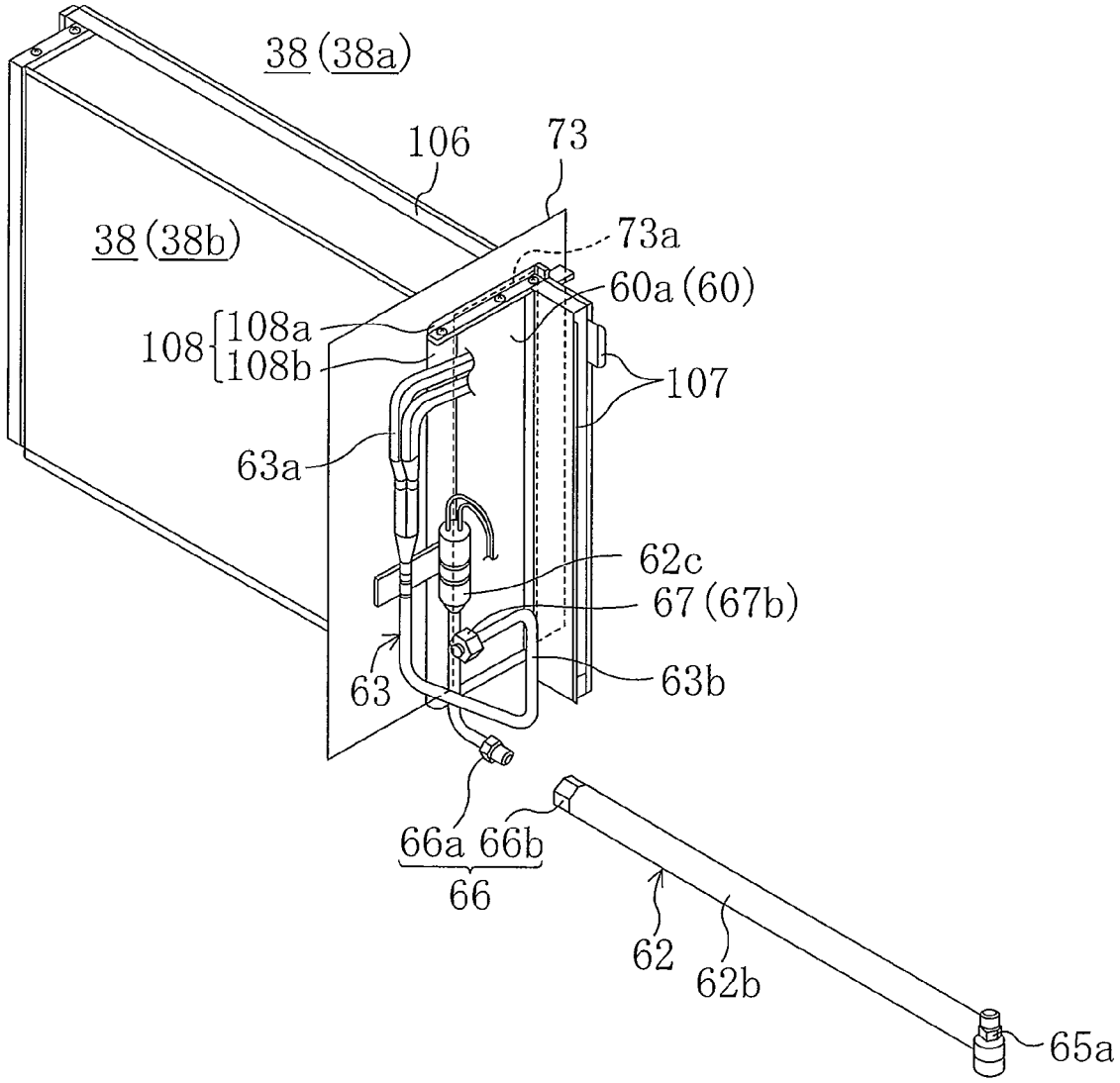
FIG. 16 shows a state where the straight pipe is pulled out from the state in FIG. 9.

Then, when maintaining also the second adsorption heat exchanger (52), the fourth joint member (66) is disconnected first. In this process, a sufficient space is provided inside the first heat exchanger chamber (37), and it is therefore possible to easily disconnect the fourth joint member (66). When the fourth joint member (66) and the third joint member (65) are disconnected as described above, the straight pipe (62*b*) is removed from the refrigerant circuit (50). Therefore, in this state, the straight pipe (62*b*) can be separately pulled out to the outside of the casing (11) (see FIG. 16).

Figure 17:
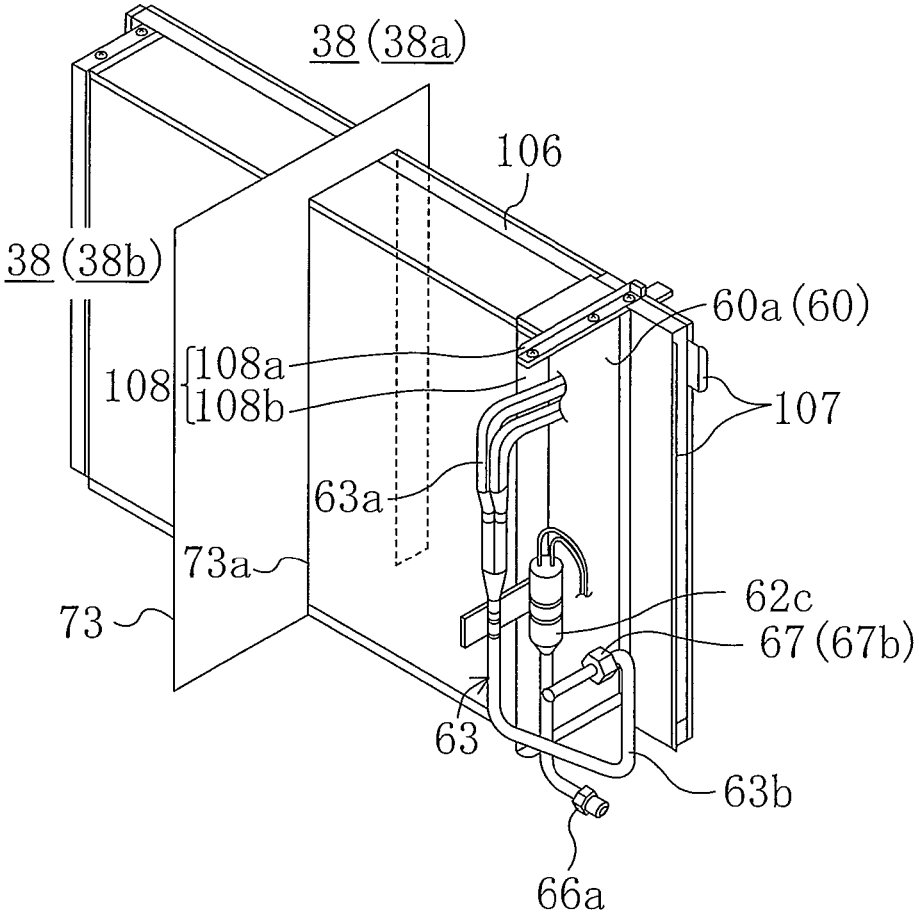
FIG. 17 shows a state where the second adsorption heat exchanger is pulled out from the state in FIG. 9.

Then, the second joint member (67) is disconnected. As a result, the second adsorption heat exchanger (52) is removed from the refrigerant circuit (50). The second adsorption heat exchanger (52) in this state is pulled out toward the first side surface panel portion (14) along the rail members (102, 102). As a result, the second adsorption heat exchanger (52) moves toward the first heat exchanger chamber (37) passing through the partition opening (73*a*) of the center partition (73). When the second adsorption heat exchanger (52) is slid as described above, components integral with the second adsorption heat exchanger (52) also move together with the second adsorption heat exchanger (52) (see FIG. 17). Specifically, components integrally moving with the second adsorption heat exchanger (52) include the second framing member (106), the second gas-side header (63*a*), the second inner pipe (63*b*), the flare nut (67*b*) of the second joint member (67), the second liquid-side distributor (62*c*), the joint main body (66*a*) of the fourth joint member (66), etc. By further pulling out the second adsorption heat exchanger (52), etc., which have moved to the first heat exchanger chamber (37), as described above, they can be maintained. Note that one may disconnect the second joint member (67) before taking out the straight pipe (62*b*), and may disconnect the fourth joint member (66) after slightly pulling out the second adsorption heat exchanger (52).

After the completion of the maintenance described above, the components are put back to the original positions by following the procedure generally reversed from that described above. That is, the second adsorption heat exchanger (52) is pushed into the second heat exchanger chamber (38) along the rail members (102, 102) and is connected with the second joint member (67), and the straight pipe (62*b*) is also pushed into the first heat exchanger chamber (37) and is connected with the fourth joint member (66). Then, the first adsorption heat exchanger (51) is pushed into the first heat exchanger chamber (37) along the rail members (102, 102). In this process, the left end portion of the first framing member (104) integral with the first adsorption heat exchanger (51) is held by the fastening member (107) shown in FIG. 15. Thus, the first framing member (104) and the second framing member (106) are connected integrally together, and the fixed state of each framing member (104, 106) is stabilized. Then, the first joint member (64) and the third joint member (65) are connected, and the second open/close panel (74*a*) is closed. Simultaneously, the first framing member (104) and the first partition (74) are fastened with the screws (104*a*, 104*a*). Then, by closing the first open/close panel (14*a*), the humidity control apparatus (10) is brought back to the original state shown in FIG. 1.

Advantages of Embodiment

In the embodiment above, each adsorption heat exchanger (51, 52) can be removed from the refrigerant circuit (50), and the adsorption heat exchangers (51, 52) of the heat exchanger chambers (37, 38) can be pulled out to the outside of the casing (11) through the maintenance opening of the first open/close panel (14*a*) and the second open/close panel (74*a*). Therefore, it is possible to easily take out and maintain the adsorption heat exchangers (51, 52).

Since the adsorption heat exchangers (51, 52) can be pulled out from the side surface of the casing (11) of the same direction (i.e., the first side surface panel portion (14)), the space for maintenance to be provided outside the casing (11) can be minimized, thus improving the degree of freedom in terms of the place where the casing (11) can be installed.

Since the adsorption heat exchangers (51, 52) can be pulled out separately, the depth of the space for maintenance can be shorter than that when the adsorption heat exchangers (51, 52) are pulled out integrally, for example.

Moreover, four joint members (64, 65, 66, 67) are provided so that the straight pipe (62*b*) can be pulled out separately, thereby improving the ease of maintenance. Specifically, if the third joint member (65) is absent in such a configuration as shown in FIG. 9, for example, it is necessary to disconnect the fourth joint member (66) closer to the center partition (73) when pulling out the first adsorption heat exchanger (51). It is not easy to disconnect the fourth joint member (66) in a state where the first adsorption heat exchanger (51) is placed in the first heat exchanger chamber (37). If the fourth joint member (66) is absent in such a configuration as shown in the figure, the second adsorption heat exchanger (52) needs to be pulled out to the outside of the casing (11) together with the straight pipe (62*b*), after taking out the first adsorption heat exchanger (51). In such a case, there is needed the entire length in the pull-out direction of the second adsorption heat exchanger (52) and the straight pipe (62*b*) combined together, as the depth of the maintenance space outside the casing (11).

On the other hand, by providing the joint members (65, 66) on opposite ends of the straight pipe (62*b*) as in the embodiment above, the operation of connecting or disconnecting the joint members (65, 66) is made easier, and the depth of the maintenance space can be minimized by pulling out the straight pipe (62*b*) separately.

Moreover, since all the joint members (64, 65, 66, 67) are put together in the first heat exchanger chamber (37), it is possible to easily perform the operation of connecting or disconnecting the joint members (64, 65, 66, 67) from the maintenance opening side. In the first heat exchanger chamber (37), since the width dimension W1 of the first downstream-side space (37*b*) is larger than the width dimension W2 of the first upstream-side space (37*a*) (see FIG. 3), and all the joint members (64, 65, 66, 67) are placed in the wider first downstream-side space (37*b*), it is possible to more easily perform the operation of connecting or disconnecting the joint members (64, 65, 66, 67).

By forming the partition opening (73*a*) in the center partition (73), it is possible to pull out the second adsorption heat exchanger (52) into the first heat exchanger chamber (37) through the partition opening (73*a*) without removing the center partition (73) from the casing (11). Here, in the second adsorption heat exchanger (52) in a normal placement position, the tube plate (60*a*) thereof serves also as a blocking member for blocking the partition opening (73*a*), and it is therefore possible to suppress the leakage of the air between the two heat exchanger chambers (37, 38).

Other Embodiments

The following configurations may be employed for the embodiment above. While the refrigerant circuit (50) is provided with four joint members (64, 65, 66, 67) in the embodiment above, the number of joint members may be changed to two or three. Specifically, in the refrigerant circuit (50) of the embodiment above, the third joint member (65) and the fourth joint member (66) may be omitted. In such a case, the two adsorption heat exchangers (51, 52) can be integrally removed from the refrigerant circuit (50) by disconnecting the first joint member (64) and the second joint member (67). In the refrigerant circuit (50) of the embodiment above, only one of the third joint member (65) and the fourth joint member (66) may be omitted.

In the embodiment above, the space (37*b*) on the downstream side in the first heat exchanger chamber (37) is wider than the space (37*a*) on the upstream side, with the joint members (64, 65, 66, 67) being placed in the space (37*b*) on the downstream side. Alternatively, the space (37*a*) on the upstream side may be wider than the space (37*b*) on the downstream side, with the joint members (64, 65, 66, 67) being placed in the space (37*a*) on the upstream side.

Note that the embodiments above are essentially illustrative of preferred embodiments, and are not intended to limit the present invention, applications thereof, or the range of applications thereof.

INDUSTRIAL APPLICABILITY

Thus, the present invention is useful as a humidity control apparatus for controlling the humidity of the air with an adsorption heat exchanger.

The invention claimed is:

1. A humidity control apparatus comprising:

a refrigerant circuit, to which first and second adsorption heat exchangers carrying an adsorbent are connected and through which refrigerant circulates to perform a refrigeration cycle; and a casing in which first and second heat exchanger chambers are formed, wherein the first and second adsorption heat exchangers share a common axis perpendicular to a direction of air flow through the first and second heat exchangers, where in each chamber a corresponding one of the first and second adsorption heat exchangers is placed, wherein the adsorbent of the adsorption heat exchangers is heated or cooled by the refrigerant of the refrigerant circuit while bringing an air into contact with the adsorbent of the adsorption heat exchangers, thereby controlling a humidity of the air, wherein the casing has a maintenance opening formed therein for exposing an inside of one of the heat exchanger chambers to an outside of the casing, a plurality of joint members for removing the first and second adsorption heat exchangers from the refrigerant circuit are connected to the refrigerant circuit, the first and second adsorption heat exchangers are configured to be pulled out along the common axis to the outside of the casing through the maintenance opening, the first heat exchanger chamber in which the first adsorption heat exchanger is placed and the second heat exchanger chamber in which the second adsorption heat exchanger is placed are formed in the casing along the common axis from a near side to a far side of the maintenance opening, a partition extending in a direction parallel to the direction of air flow and perpendicular to the common axis is formed between the first heat exchanger chamber and the second heat exchanger chamber for separating the heat exchanger chambers from each other, a partition opening through which the second adsorption heat exchanger is configured to pass is formed in the partition so as to allow the second adsorption heat exchanger to move between the heat exchanger chambers along the common axis, the second adsorption heat exchanger has a plurality of heat transfer pipes and a tube plate, the heat transfer pipes extending in a direction along the common axis, and the tube plate supporting an end portion of each of the heat transfer pipes on the partition side, and the tube plate of the second adsorption heat exchanger on the partition side fits so as to be coincident with the partition opening in a state in which the second adsorption heat exchanger is placed in the second heat exchanger chamber.

2. The humidity control apparatus of claim 1, wherein a first joint member, which is connected to a gas-side pipe of the first adsorption heat exchanger, a second joint member, which is connected to a gas-side pipe of the second adsorption heat exchanger, and a third joint member, which is connected to a liquid-side pipe between the first adsorption heat exchanger and the second adsorption heat exchanger, are connected to the refrigerant circuit.

3. The humidity control apparatus of claim 2, wherein the third joint member and a fourth joint member are connected to the liquid-side pipe from a side of the first adsorption heat exchanger toward a side of the second adsorption heat exchanger, and the third joint member is placed closer to the maintenance opening in the first heat exchanger chamber, and the fourth joint member is placed closer to a side opposite to the maintenance opening in the first heat exchanger chamber.

4. The humidity control apparatus of claim 1, wherein the plurality of joint members are all placed in the first heat exchanger chamber.

5. The humidity control apparatus of claim 1, wherein the first and second heat exchanger chambers each include spaces, one defined on an upstream side of the respective adsorption heat exchanger and another defined on a downstream side of the respective adsorption heat exchanger, with the respective adsorption heat exchanger interposed therebetween, a width dimension in an air flow direction of one of the space on the upstream side and the space on the downstream side is larger than a width dimension in the air flow direction of the other space, and the joint members are provided in one of the spaces of the larger width dimension in the heat exchanger chamber.

6. The humidity control apparatus of claim 5, wherein the width dimension of the space on the downstream side of each adsorption heat exchanger in the heat exchanger chamber is larger than the width dimension of the space on the upstream side of each adsorption heat exchanger.

7. The humidity control apparatus of one of claim 1, 2, 3, 4, 5 or 6, wherein the first and second heat exchanger chambers are provided with a rail member, extending in a direction along the common axis in which the adsorption heat exchanger is pulled out, for guiding the adsorption heat exchanger toward the maintenance opening.

8. A humidity control apparatus comprising:

a refrigerant circuit, to which first and second adsorption heat exchangers carrying an adsorbent are connected and through which refrigerant circulates to perform a refrigeration cycle; and a casing in which heat exchanger chambers are formed in each of which a corresponding one of the first and second adsorption heat exchangers is placed, wherein the adsorbent of the adsorption heat exchangers is heated or cooled by the refrigerant of the refrigerant circuit while bringing an air into contact with the adsorbent of the adsorption heat exchanger, thereby controlling a humidity of the air, wherein the casing has a maintenance opening formed therein for exposing an inside of each of the heat exchanger chambers to an outside of the casing, a plurality of joint members for removing the first and second adsorption heat exchangers from the refrigerant circuit are connected to the refrigerant circuit, the first and second adsorption heat exchangers are configured to be pulled along a common axis which is perpendicular to a direction of air flow through the first and second adsorption heat exchangers out to the outside of the casing through the maintenance opening, a first heat exchanger chamber in which the first adsorption heat exchanger is placed and a second heat exchanger chamber in which the second adsorption heat exchanger is placed are formed in the casing, wherein the first and second adsorption heat exchangers are arranged along the common axis from a near side to a far side of the maintenance opening, a first joint member connected to a gas-side end portion of the first adsorption heat exchanger, a second joint member connected to a gas-side end portion of the second adsorption heat exchanger, a third joint member connected to a liquid-side end portion of the first adsorption heat exchanger, a fourth joint member connected to a liquid side-end portion of the second adsorption heat exchanger, and a liquid pipe interposed between the third and fourth joint members are provided in the refrigerant circuit, the first and third joint members are placed closer to the maintenance opening in the first heat exchanger chamber, and the second and fourth joint members are placed closer to a side opposite to the maintenance opening in the first heat exchanger chamber.

* * * * *